US009017090B2

(12) United States Patent
Matsumoto et al.

(10) Patent No.: US 9,017,090 B2
(45) Date of Patent: Apr. 28, 2015

(54) ELECTRICAL CONNECTOR AND SQUIB CONNECTION DEVICE

(71) Applicant: J.S.T. Mfg. Co., Ltd., Osaka-shi (JP)

(72) Inventors: Hiroyuki Matsumoto, Yokohama (JP); Munetaka Yasuda, Yokohama (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 0 days.

(21) Appl. No.: 14/093,817

(22) Filed: Dec. 2, 2013

(65) Prior Publication Data

US 2014/0154911 A1 Jun. 5, 2014

(30) Foreign Application Priority Data

Dec. 3, 2012 (JP) ..... 2012-264804

(51) Int. Cl.

| | |
|---|---|
| ***H01R 13/637*** | (2006.01) |
| ***H01R 13/635*** | (2006.01) |
| ***H01R 13/627*** | (2006.01) |
| *H01R 13/64* | (2006.01) |

(52) U.S. Cl.

CPC ..... *H01R 13/635* (2013.01); *H01R 13/6275* (2013.01); *H01R 13/64* (2013.01)

(58) Field of Classification Search

USPC ..... 439/350, 370, 352–354

See application file for complete search history.

(56) References Cited

U.S. PATENT DOCUMENTS

| | | | | |
|---|---|---|---|---|
| 5,895,282 | A * | 4/1999 | Little | 439/332 |
| 6,530,799 | B2 * | 3/2003 | Regnier et al. | 439/352 |
| 6,811,424 | B2 * | 11/2004 | Seminara et al. | 439/352 |
| 6,945,801 | B2 * | 9/2005 | Brown | 439/352 |
| 7,229,305 | B2 * | 6/2007 | Hirschmann | 439/352 |
| 2008/0293275 | A1 * | 11/2008 | Osada et al. | 439/188 |

FOREIGN PATENT DOCUMENTS

JP 2012-22990 A1 2/2012

* cited by examiner

*Primary Examiner* — Briggitte R Hammond

(74) *Attorney, Agent, or Firm* — Kratz, Quintos & Hanson, LLP

(57) ABSTRACT

An electrical connector of the present invention is configured such that when abutting portions of leg portions of a support member are abutted against receiving faces of jutting portions of a retainer, and a connector housing at a first position is pressed toward the mating side, an elastic member undergoes elastic deformation. If the connector housing does not reach a second position, the connector housing returns to the first position by elastic restoring force of the elastic member. If the connector housing reaches the second position, then the abutting portions move away from the receiving faces due to being pressed by pressing portions, the support member is pressed toward the mating side due to being subjected to the elastic restoring force of the elastic member, and the connector housing becomes relatively positioned at the first position. Also, a squib connection device of the present invention includes this electrical connector.

18 Claims, 15 Drawing Sheets

ELECTRICAL CONNECTOR AND SQUIB CONNECTION DEVICE

BACKGROUND OF THE INVENTION

1. Field of the Invention

The present invention belongs to the technical field of electrical connectors, relates to an electrical connector for connection with a partner device that has an inflator housing, a squib, and a retainer, and also relates to a squib connection device that includes the partner device and the electrical connector.

2. Description of the Related Art

JP-2012-22990-A discloses a connector that can suppress deformation of a locking arm that presses a slider assembled to a housing via a biasing means. This connector includes an initiator and a housing. A shunt of the initiator is provided with the locking arm. A slider is assembled, via a spring, to a terminal housing portion provided in a housing body of the housing. When mounting the housing to the initiator, the locking arm rides up the housing, then comes into contact with an arm reception portion of the slider and presses the slider in resistance to the biasing of the spring, and then undergoes restoration so as to become locked with the terminal housing portion. The end face of the slider that comes into contact with the locking arm is tapered so as to guide the locking arm in the restoring direction of the locking arm.

SUMMARY OF THE INVENTION

With regards to the connector of this patent document, if the force for moving the housing rearward is removed before the mating of the housing and the initiator is complete, the slider will move rearward due to the biasing force of the spring, the locking arm will be pressed rearward by the tapered portion, and the housing and initiator will become separated from each other (see paragraph 0021 of the patent document). This prevents incomplete mating of the housing and the initiator.

However, the shunt of the connector of this patent document has a complex shape due to the locking arm being provided in the shunt. Also, as the housing is mated to the initiator, the spring is not compressed until the mated length reaches a predetermined length at which the tapered portion of the reception portion of the slider comes into contact with the spring. Before the mated length reaches the predetermined length, elastic restoring force is not generated by the spring and, therefore, force for separating the housing and the initiator is not exerted, and an operational error can possibly occur in which the mating operation is ended regardless of the fact that the mating of the housing and the initiator is incomplete. Moreover, the pins will have already come into contact with the terminals before the mated length has reached the predetermined length (see FIGS. 4 and 5 of the patent document). The pins therefore conduct electricity to the terminals regardless of the fact that the mating of the housing and the initiator is incomplete. Of course, the two pins are shorted by shorting fittings that are fitted into housing recession portions of the shunt and, therefore, even if the mating of the housing and the initiator is incomplete, current will not flow through the two pins as long as the shorting fittings are in elastic contact with the two pins. However, if the shorting fittings are not provided, current will flow through the two pins due to the pins conducting electricity to the terminals regardless of the fact that the mating of the housing and the initiator is incomplete.

An object of the present invention is to provide an electrical connector and a squib connection device that can solve the above-described problems.

An electrical connector according to one aspect of the present invention includes:

a support member;

a connector housing that has a mating portion capable of being mated to a retainer attached to a socket that is recessed toward a counter mating side from a surface of an inflator housing on a mating side, and that is provided such that the position of the connector housing relative to the support member can move between a first position and a second position that is on the mating side relative to the first position;

an electrical terminal that is provided in the connector housing and has a contact portion that can come into contact with a squib terminal rising up toward the mating side from a bottom portion of the socket at least when the mating portion of the connector housing is mated to the retainer; and an elastic member that is provided between the support member and the connector housing and presses the connector housing toward the counter mating side relative to the support member using elastic restoring force, wherein the support member is provided with a flexible leg portion that extends toward the mating side, an end portion on the mating side of the leg portion being provided with an abutting portion capable of abutting against a receiving face formed on the mating side of a jutting portion that is provided on the retainer so as to jut out laterally, wherein the connector housing is provided with a pressing portion that presses the leg portion laterally such that the leg portion moves away from the receiving face when the connector housing moves from the first position to the second position, and when the abutting portion of the leg portion of the support member is abutted against the receiving face of the jutting portion of the retainer, and the connector housing at the first position is pressed toward the mating side, the elastic member undergoes elastic deformation, and if the connector housing does not reach the second position, the connector housing returns to the first position due to being pressed in the counter mating direction relative to the support member by elastic restoring force of the elastic member, and if the connector housing reaches the second position, the abutting portion moves away from the receiving face due to being pressed by the pressing portion, the support member is pressed toward the mating side due to being subjected to elastic restoring force of the elastic member, and the connector housing becomes relatively positioned at the first position.

In the case where the abutting portion of the leg portion of the support member is abutted against the receiving face of the jutting portion of the retainer and the connector housing at the first position is pressed toward the mating side, the mating portion of the connector housing is not mated to the retainer until the connector housing reaches the second position. Then when the connector housing reaches the second position, the mating portion of the connector housing is mated to the retainer, and the connector housing is relatively positioned at the first position. In this way, the position of the connector housing relative to the support member is used to check whether or not the mating portion of the connector housing has been mated to the retainer; thus, facilitating the prevention of incomplete mating of the mating portion of the connector housing to the retainer. Also, the retainer has a simple structure since the retainer does not have members corresponding to the locking arms of the above-described patent document.

When the mating portion of the connector housing is to be mated to the retainer, the connector housing is pressed toward the mating side, and when the connector housing is mated to the retainer, the support member is pressed toward the mating side. For this reason, the operator cannot select from various patterns of operational content, such as first pressing the connector housing toward the mating side and then pressing the support member toward the mating side, or first pressing the support member toward the mating side and then pressing the connector housing toward the mating side, or pressing both at the same time. This results in a small risk of incomplete mating due to differences in operational content.

A squib connection device according to another aspect of the present invention includes:

a partner device including:

an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector that can be mated to the partner device, wherein the electrical connector includes:

a support member, a connector housing that has a mating portion capable of being mated to the retainer, and that is provided such that the position of the connector housing relative to the support member can move between a first position and a second position that is on the mating side relative to the first position, an electrical terminal that is provided in the connector housing and has a contact portion that can come into contact with the squib terminal at least when the mating portion of the connector housing is mated to the retainer, and an elastic member that is provided between the support member and the connector housing and presses the connector housing toward the counter mating side relative to the support member using elastic restoring force, wherein the support member is provided with a flexible leg portion that extends toward the mating side, an end portion on the mating side of the leg portion being provided with an abutting portion capable of abutting against a receiving face formed on the mating side of a jutting portion that is provided on the retainer so as to jut out laterally, wherein the connector housing is provided with a pressing portion that presses the leg portion laterally such that the leg portion moves away from the receiving face when the connector housing moves from the first position to the second position, and wherein when the abutting portion of the leg portion of the support member is abutted against the receiving face of the jutting portion of the retainer, and the connector housing at the first position is pressed toward the mating side, the elastic member undergoes elastic deformation, and if the connector housing does not reach the second position, the connector housing returns to the first position due to being pressed in the counter mating direction relative to the support member by elastic restoring force of the elastic member, and if the connector housing reaches the second position, the abutting portion moves away from the receiving face due to being pressed by the pressing portion, the support member is pressed toward the mating side due to being subjected to elastic restoring force of the elastic member, and the connector housing becomes relatively positioned at the first position.

In the case where the abutting portion of the leg portion of the support member is abutted against the receiving face of the jutting portion of the retainer and the connector housing at the first position is pressed toward the mating side, the mating portion of the connector housing is not mated to the retainer until the connector housing reaches the second position. Then when the connector housing reaches the second position, the mating portion of the connector housing is mated to the retainer, and the connector housing is relatively positioned at the first position. In this way, the position of the connector housing relative to the support member is used to check whether or not the mating portion of the connector housing has been mated to the retainer, thus facilitating the prevention of incomplete mating of the mating portion of the connector housing to the retainer. Also, the retainer has a simple structure since the retainer does not have members corresponding to the locking arms of the above-described patent document.

When the mating portion of the connector housing is to be mated to the retainer, the connector housing is pressed toward the mating side, and when the connector housing is mated to the retainer, the support member is pressed toward the mating side. For this reason, the operator cannot select from various patterns of operational content, such as first pressing the connector housing toward the mating side and then pressing the support member toward the mating side, first pressing the support member toward the mating side and then pressing the connector housing toward the mating side, or pressing both at the same time. This results in a small risk of incomplete mating due to differences in operational content.

DETAILED DESCRIPTION OF THE INVENTION

Figure 1:
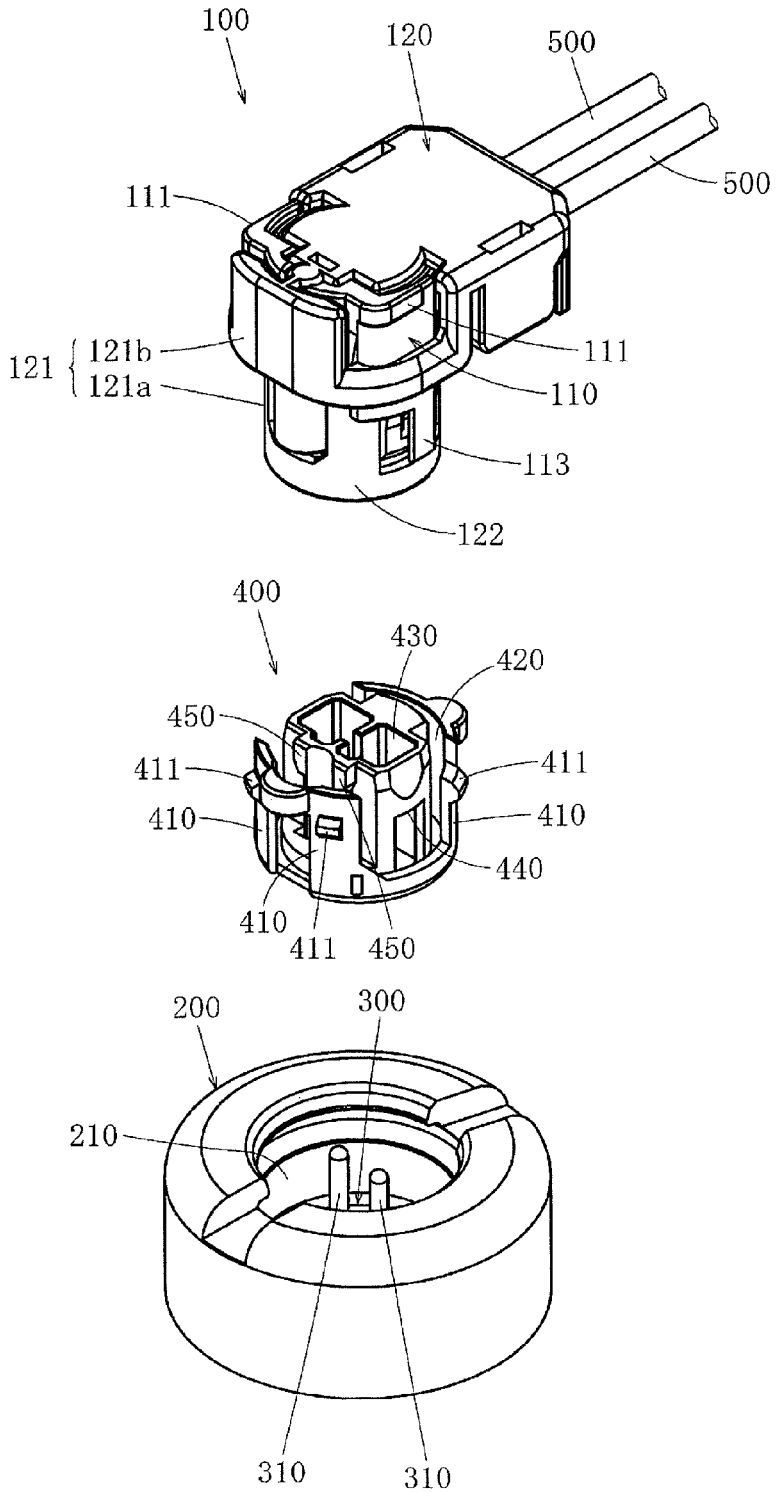
FIG. 1 is an exploded perspective view of an embodiment of an electrical connector and a squib connection device of the present invention.
Figure 6:
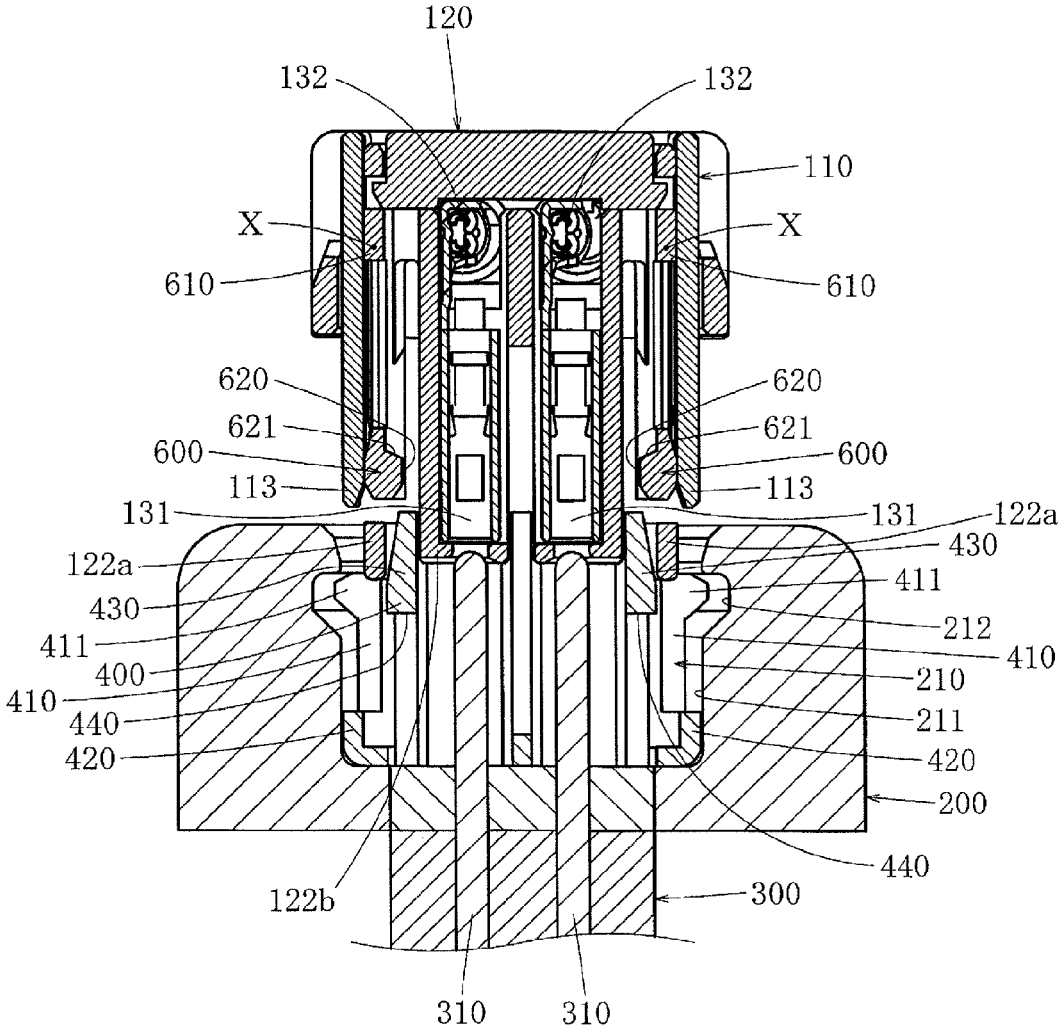
FIG. 6 is an enlarged cross-sectional view taken along line VI-VI in FIG. 5. A connector housing is at a first position.

Embodiments of the present invention will be described below. FIGS. 1 to 13 show an embodiment of an electrical connector and a squib connection device according to the present invention. The electrical connector and the squib connection device are elements constituting an inflator, which is a device for inflating an airbag. As shown in FIG. 1, the squib connection device includes a partner device and an electrical connector 100 for mating with the partner device. The partner device has an inflator housing 200, a squib 300, and a retainer 400. In both the electrical connector 100 and the partner device that are to be mated to each other, the mating side refers to the side on which the one is to be mated to the other, and the mating direction refers to the direction in which the one faces the other when the electrical connector 100 and the partner device are arranged such that their mating sides oppose each other. The counter mating side is the side opposite to the mating side and the counter mating direction is the direction opposite to the mating direction. Hereinafter, when the mating side, the mating direction, the counter mating side, or the counter mating direction relative to a member or portion is simply referred to, if that member or portion is provided in the electrical connector 100, that side or direction refers to the mating side, the mating direction, the counter mating side, or the counter mating direction of the electrical connector 100. If that member or portion is provided in the partner device, that side or direction refers to the mating side, the mating direction, the counter mating side, or the counter mating direction of the partner device. Accordingly, when FIG. 6 is oriented such that the reference signs can be read properly, the mating side of the electrical connector 100 refers to the lower side of the electrical connector 100 in the figure, the mating direction refers to the downward direction of the electrical connector 100 in the figure, the counter mating side refers to the upper side of the electrical connector 100 in the figure, and the counter mating direction refers to the upward direction of the electrical connector 100 in the figure. Also, in the same figure, the mating side of the partner device refers to the upper side of the partner device in the figure, the mating direction refers to the upward direction of the partner device in the figure, the counter mating side refers to the lower side of the partner device in the figure, and the counter mating direction refers to the downward direction of the partner device in the figure.

The inflator housing 200 shown in FIGS. 1 and 5 to 13 is formed from an aluminum alloy, and it may be formed from a conductive material in this way, or it may be formed from an insulating material or another material. The inflator housing 200 is provided with a socket 210 that is recessed toward the counter mating side from the surface on the mating side. The socket 210 is formed such that the interior space is shaped as a circular column, but it may be formed such that the interior space is shaped as a prism or has another shape.

As shown in FIGS. 1 and 6 to 13, a pair of squib terminals 310 that rise up toward the mating side are provided on the mating side of the squib 300. These squib terminals 310 are formed from a conductive material and are bar-shaped, but they may be tube-shaped or plate-shaped, or have another shape. The squib terminals 310 are also sometimes called "pins". When current is applied to the squib 300 via the pair of squib terminals 310, the squib 300 receives the electrical energy and generates heat. Since the inflator housing 200 is formed from a conductive material, an insulating member is provided so as to surround the squib terminals 310, thus insulating the squib terminals 310 and the inflator housing 200 from each other. Depending on how grounding is performed, for example, the squib terminals can be monopolar or have three or more poles. The squib 300 is provided on the counter mating side of the inflator housing 200 such that the squib terminals 310 rise up toward the mating side from the bottom portion of the socket 210. An igniting agent and a gas-forming agent are arranged so as to surround the squib 300. A compressed airbag is accommodated in the counter mating side of the inflator housing 200. Accordingly, when the squib 300 receives electrical energy and generates heat, the igniting agent ignites, thus, the gas-forming agent forms gas, and that gas deploys the airbag.

The retainer 400 shown in FIG. 1 is formed from a synthetic resin, and it may be formed from an insulating material in this way, or it may be formed from a conductive material or another material in the case of employing a configuration in which it is insulated from the squib terminals 310 or later-described electrical terminals 130. The retainer 400 is formed such that its external shape corresponds to the interior space of the socket 210 and therefore, in the case of this embodiment, the outer periphery of a horizontal cross-section of the retainer 400 is substantially circular. However, the outer periphery of the horizontal cross-section of the retainer may be polygonal or have another shape as long as it can fit in the interior space of the socket 210. The retainer 400 is provided with a cavity that penetrates in the mating direction and allows the introduction of the squib terminals 310 from the counter mating side. The retainer 400 is attached to the socket 210. In order to ensure force for engaging the retainer 400 and the socket 210, the retainer 400 is provided with attachment arms 410 and projections 411 provided on the attachment arms 410 fit into a groove 212 provided in the socket 210. Each attachment arm 410 extends in the mating direction in the periphery of the retainer 400, one end being fixed to the retainer 400, and the other end being provided with a projection 411 that projects outward. When viewing the attachment arm 410 in the mating direction, the outer side of the attachment arm 410 is the side that is away from the center of the retainer 400, and the inner side is the side opposite to the outer side. The groove 212 is provided so as to be recessed outward in a wall 211, which is a wall that constitutes the socket 210 of the inflator housing 200. When viewing the socket 210 in the mating direction, the outer side of the socket 210 is the side that is away from the center of the socket 210, and the inner side is the side opposite to the outer side. When the retainer 400 is pressed into the socket 210, the attachment arms 410 elastically deform inward due to being pressed by the wall 211, thus allowing the retainer 400 to be inserted into the socket 210, and when the projections 411 reach the position of the groove 212, the attachment arms 410 return to their original state, and the projections 411 fit into the groove 212, and the retainer 400 and the socket 210 are thus engaged with each other.

Figure 3:
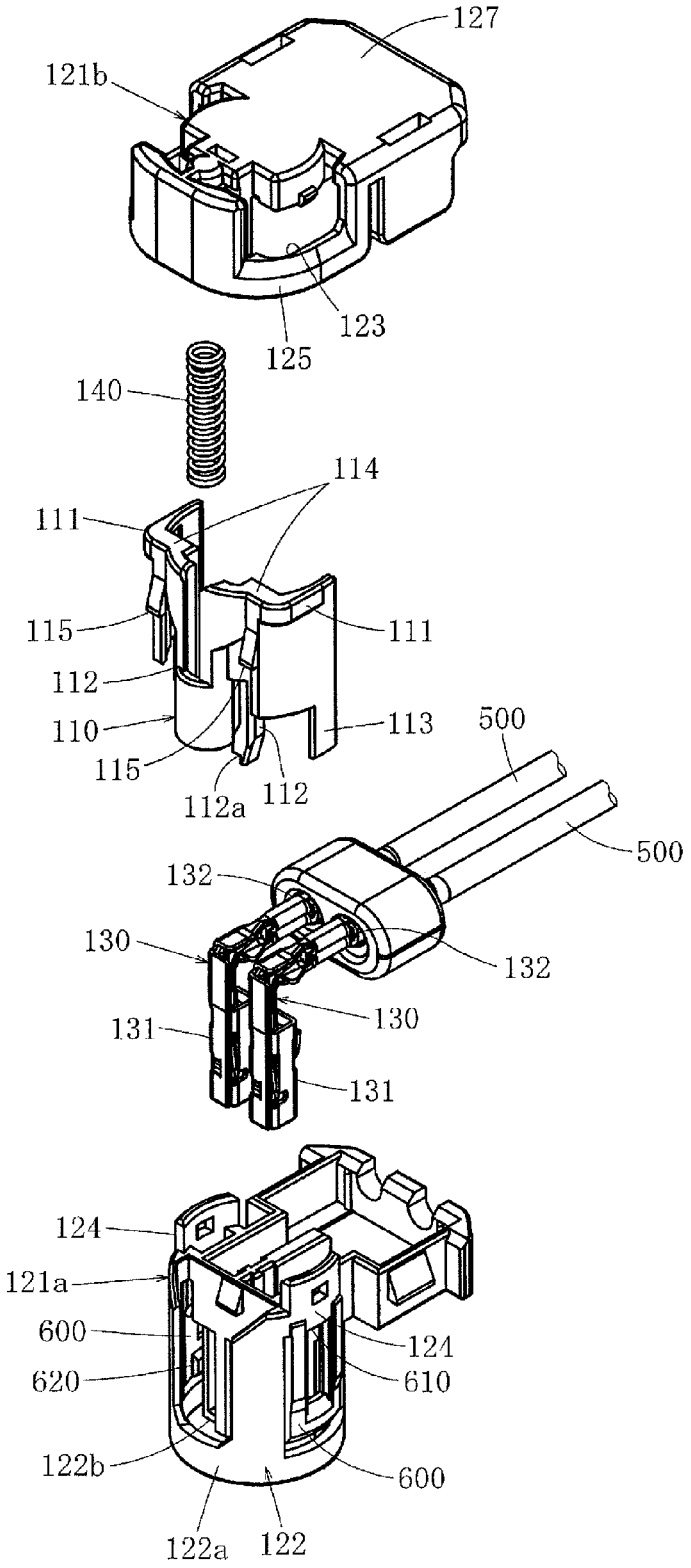
FIG. 3 is an exploded perspective view of the electrical connector of the embodiment.

As shown in FIG. 3, the electrical connector 100 includes a support member 110, a connector housing 120, electrical terminals 130, and an elastic member 140.

The support member 110 is formed from a synthetic resin, and it may be formed from an insulating material in this way, or it may be formed from a conductive material or another material in the case of employing a configuration in which it is insulated from the electrical terminals 130 or the squib terminals 310. As shown in FIG. 3, the support member 110 is constituted by a plate-shaped member formed so as to have a "U" shape when viewed in the mating direction, but it may have another shape.

The connector housing 120 is formed from a synthetic resin, and it may be formed from an insulating material in this way, or it may be formed from a conductive material or another material in the case of employing a configuration in which it is insulated from the electrical terminals 130 or the squib terminals 310, for example. The connector housing 120 includes a housing body 121 and a mating portion 122 that is provided on the mating side of the housing body 121 and is for mating with the retainer 400. The housing body 121 extends in a direction orthogonal to the mating direction, and the mating portion 122 extends in the mating direction from one end side of the housing body 121. However, the shapes of the housing body and the mating portion are not intended to be limited to this. The housing body may, for example, be shaped as a cuboid or the like that does not have a lengthwise direction, or may be formed such that the lengthwise direction of the housing body forms an angle greater than 0 degrees and less than 180 degrees relative to the mating direction. Also, the mating portion need only be provided on the mating side of the housing body and may be provided at any position on the face of the housing body that faces the mating direction. The mating portion 122 and the retainer 400 are mated to each other by a protruding portion provided on either one of them being inserted into a recessed portion provided on the other one, and they are detached from each other by pulling the protruding portion out of the recessed portion. As one variation, it is possible for the mating portion and the retainer to be fixedly mated to each other, that is to say, permanently mated. In the case of this embodiment, the mating portion 122 is provided with a first tube-shaped portion 122*a* as a protruding portion, the retainer 400 is correspondingly provided with a second tube-shaped portion 420 as a recessed portion, and the two are mated to each other by the first tube-shaped portion 122*a* being placed inside the second tube-shaped portion 420. Conversely, the mating may be performed by the second tube-shaped portion being placed inside the first tube-shaped portion. Although the first tube-shaped portion 122*a* and the second tube-shaped portion 420 are both shaped as circular tubes, they may be shaped as polygonal tubes or elliptical tubes, or they may have another type of tube shape. In the case of this embodiment, the mating portion 122 is further provided with a third tube-shaped portion 122*b* as a protruding portion inward of the first tube-shaped portion 122*a*, the retainer 400 is correspondingly further provided with a fourth tube-shaped portion 430 as a recessed portion inward of the second tube-shaped portion 420, and the two are mated to each other by the third tube-shaped portion 122*b* being placed inside the fourth tube-shaped portion 430. Also, the electrical terminals 130 are arranged inside the third tube-shaped portion 122*b*, the interior of the fourth tube-shaped portion 430 serves as the above-described cavity, and the squib terminals 310 are arranged therein. However, in the case where, for example, the mating portion 122 and the retainer 400 are stably mated to each other by merely the mating of the first tube-shaped portion 122*a* and the second tube-shaped portion 420 to each other, the third tube-shaped portion 122*b* and the fourth tube-shaped portion 430 do not need to be provided.

The connector housing 120 is provided such that its position relative to the support member 110 can move between a first position and a second position that is on the mating side relative to the first position. Specifically, a guiding opening 123 is formed in the connector housing 120, and the support member 110 is fitted into the guiding opening 123 so as to be able to move along the mating direction and the counter mating direction. The guiding opening 123 is provided between a vertical wall 124 that is provided closer to the center of the connector housing 120 (i.e., inward) and an outer frame 125 that is provided farther from the center of the connector housing 120 (i.e., outward). The structure for attaching the connector housing to the support member is not intended to be limited by this embodiment, and the connector housing need only be provided such that its position relative to the support member can move between the first position and the second position that is on the mating side relative to the first position. For this reason, a configuration is possible in which, for example, a groove extending in the mating direction and the counter mating direction is provided in either the connector housing or the support member, and a projection that fits into the groove is provided on the other one. Although the housing body 121 is divided into a first member 121*a* on the mating side and a second member 121*b* on the counter mating side as shown in FIG. 3, it may be provided as one integrated portion instead of being divided.

As shown in FIGS. 3, 6, 8, 10, and 12, the number of electrical terminals 130 that are provided corresponds to the number of squib terminals 310. Accordingly, in the case of this embodiment, a pair of electrical terminals 130 is provided. The electrical terminals 130 are formed from a conductive material, and they each include a contact portion 131 and a connection portion 132 and are provided in the connector housing 120. Also, the contact portions 131 are configured so as to come into contact with the squib terminals 310 at least when the mating portion 122 of the connector housing 120 has been mated to the retainer 400. The contact portions 131 may be in contact with the squib terminals 310 even when the mated length is shorter than when the mating portion 122 of the connector housing 120 has been mated with the retainer 400, and this configuration is applied in this embodiment. The mating of the mating portion 122 of the connector housing 120 to the retainer 400 refers to the mated length of the mating portion 122 and the retainer 400 reaching a mated length that has been set as the design target, as well as the electrical terminals 130 being in contact with the squib terminals 310, which is the state shown in FIGS. 12 and 13. The electrical terminals 130 are formed from plate-shaped objects, but they may be formed from another mode of material. The contact portions 131 are provided on the mating side of the electrical terminals 130, but they may be provided on, for example, the counter mating side of the electrical terminals or on another portion. Also, the contact portions 131 are configured so as to come into contact with the squib terminal 310 when the mating portion 122 is mated to the retainer 400. Since the squib terminals 310 are formed in the shape of bars, the contact portions 131 of the electrical terminal 130 are formed in the shape of tubes so as to fit around the squib terminals 310. If the squib terminals are formed in the shape of tubes, on the other hand, the contact portions of the electrical terminals may be formed in the shape of bars so as to fit into the squib terminals. The contact portions of the electrical terminals need only be formed in a shape that allows coming into contact with the squib terminals and may be formed in the shape of plates, for example, or have another shape. The connection portions 132 each include a connection structure for connection to a conducting body 500. In the case of this embodiment, the conducting body 500 is an electrical wire that includes a core wire and an insulating coating that coats the core wire. Therefore, the connection structure is constituted by a wire barrel and an insulation barrel. The wire barrel is a crimping part that rises from the plate width direction of the electrical terminal 130, and it crimps the portion of the core wire that is exposed from the end of the conducting body 500. The insulation barrel is a crimping part that rises from the plate width direction of the electrical terminal 130 on the side far from the contact portion 131 relative to the wire barrel of the electrical terminal 130, and it crimps the insulating coating on the end of the conducting body 500. The conducting body 500 includes not only the electrical wire, but also a shielded cable or an element thereof for example, includes a flat flexible cable such as an FFC (Flexible Flat Cable) or an element thereof, and furthermore includes a conducting means that includes another conducting body. Also, the connection structure may be, for example, a structure for insulation displacement of the conducting body, a structure for piercing the conducting body, a structure for soldering the conducting body, or another structure. In the case of this embodiment, the contact portion 131 is mounted inside the mating portion 122, and the connection portion 132 is mounted inside the housing body 121. Therefore, the contact portion 131 extends in the mating direction, which is the lengthwise direction of the mating portion 122, and the connection portion 132 extends in a direction orthogonal to the mating direction, which is the lengthwise direction of the housing body 121, thus making the electrical terminal 130 L-shaped, but the electrical terminal may be, for example, I-shaped or V-shaped or have another shape, and the contact portion and the connection portion may be provided outside the connector housing. FIG. 14 shows a variation of the electrical connector 100. In the case of this electrical connector 100, another electrical terminal 130' is further provided in addition to the pair of electrical terminals 130. Other aspects of the configuration are similar to the electrical connector of this embodiment. The other electrical terminal 130' includes a contact portion 131' provided on the mating side, and a connection portion (not shown) that has a connection structure for connection with another conducting body 500'. The contact portion 131' protrudes outward from an opening provided in the mating portion 122, and when the mating portion 122 is mated to the retainer 400, the contact portion 131' comes into contact with the wall 211 of the socket 210 and conducts electricity to the inflator housing 200. The other conducting body 500' is an electrical wire configured similarly to the conducting body 500, and it includes not only the electrical wire, but also a shielded cable or an element thereof for example, includes a flat flexible cable such as an FFC or an element thereof, and furthermore includes a conducting means that includes another conducting body. The connection portion of the other electrical terminal 130' is configured similarly to the connection portions 132 of the electrical terminals 130, and it is connected to the other conducting body 500' in a similar manner to the connection portions 132. Furthermore, there is a variation of the electrical connector 100 in which connection with a shielded cable is performed. In this variation, for example, the signal wire of the shielded cable is connected to the connection portion 132 of the electrical terminal 130 as the conducting body 500, and the outer conducting body of the shielded cable is connected to the connection portion of the other electrical terminal 130' as the other conducting body 500'. There are also modes in which the electrical terminals do not include the connection portion. Among such modes, there is a mode of the electrical terminals in which electrical conduction with the outside is performed in a contactless manner.

Figure 4:
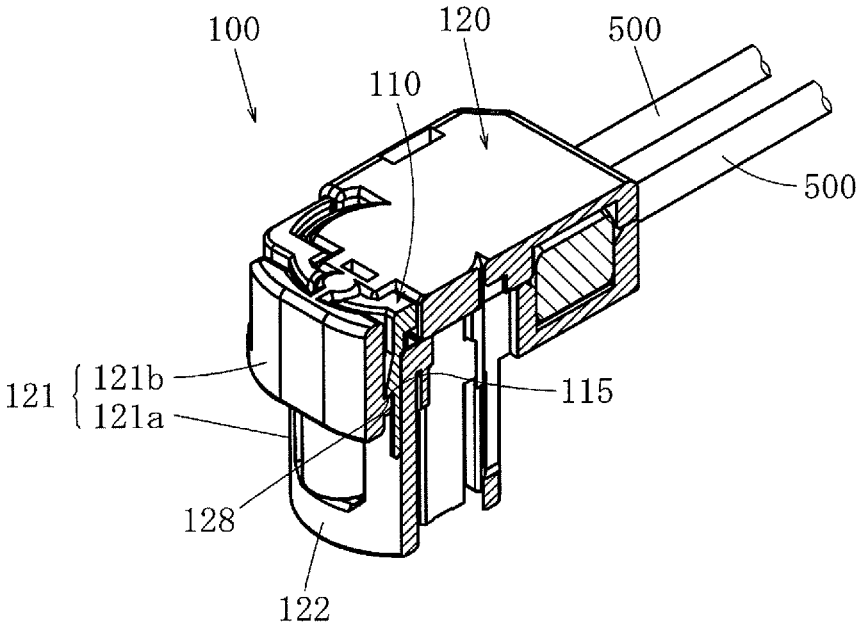
FIG. 4 is a perspective view of a vertical cross-section of the electrical connector of the embodiment.
Figure 5:
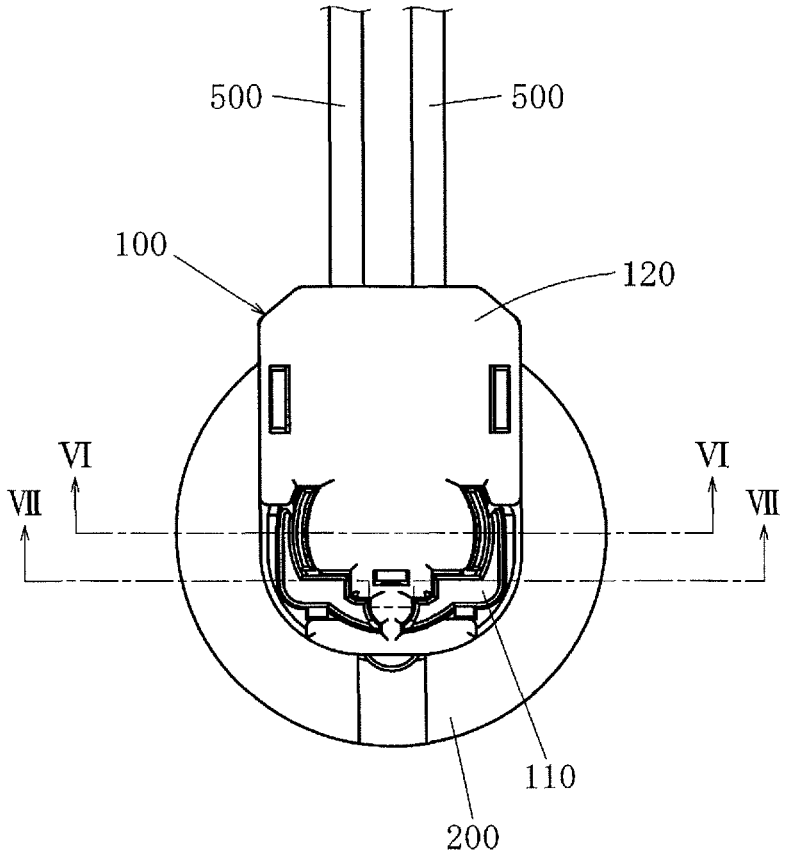
FIG. 5 is a plan view of the squib connection device of the embodiment as viewed from the counter mating side of the electrical connector.
Figure 7:
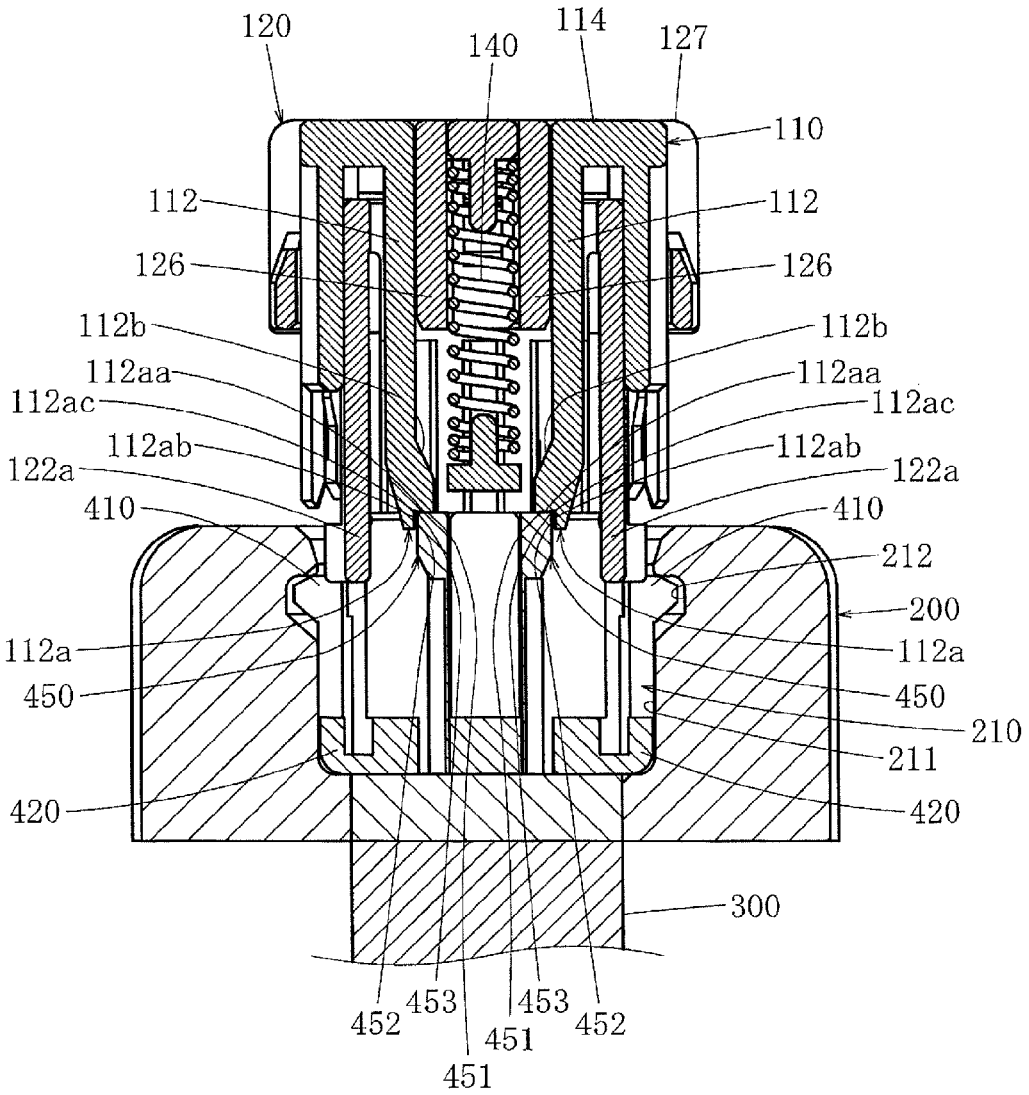
FIG. 7 is an enlarged cross-sectional view taken along line VII-VII in FIG. 5. The state is the same as in FIG. 6, and abutting portions of leg portions of a support member are abutted against receiving faces of jutting portions of a retainer.
Figure 8:
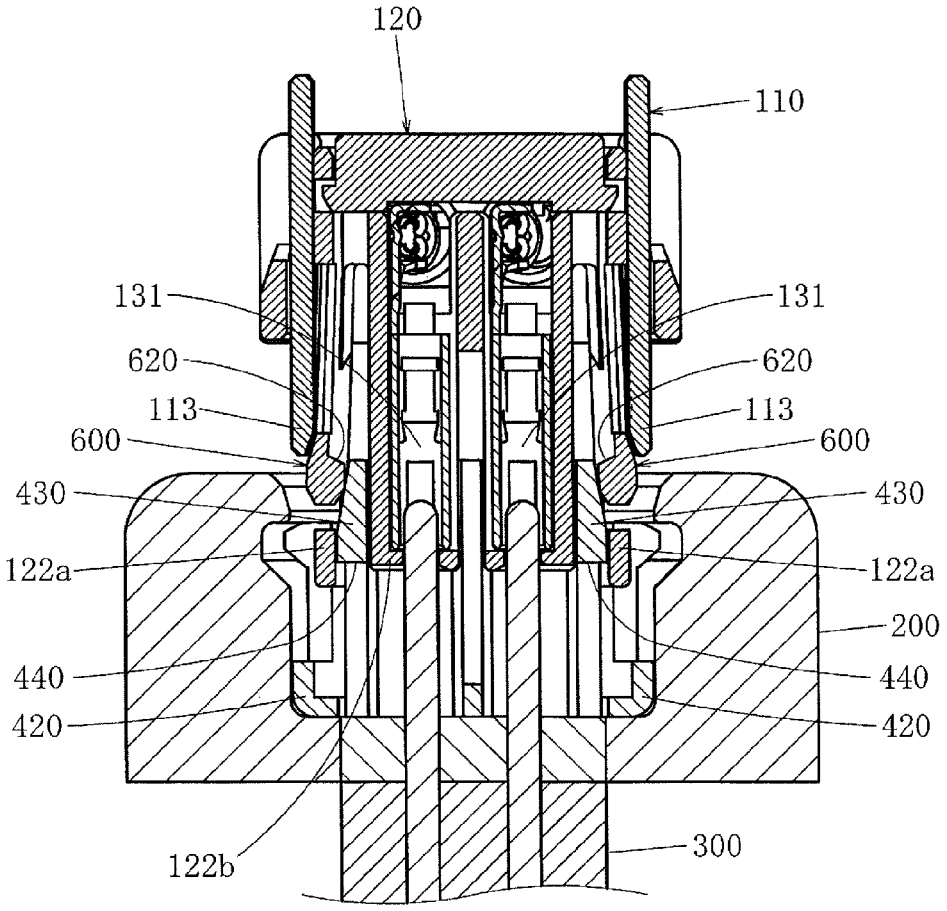
FIG. 8 is a diagram corresponding to FIG. 6. The state has changed from the state shown in FIGS. 6 and 7 to a state in which the connector housing is being pressed toward the mating side. Projection portions of lock arms are riding up a wall of the retainer.
Figure 9:
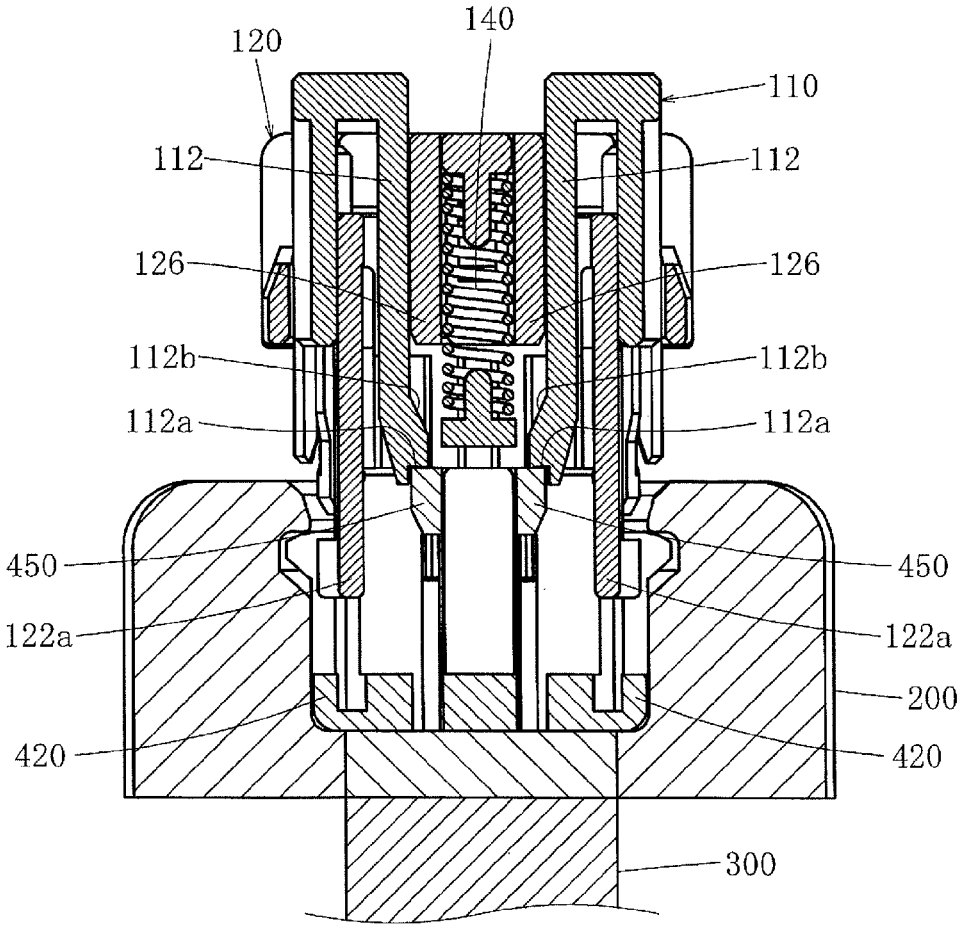
FIG. 9 is a diagram corresponding to FIG. 7. The state is the same as in FIG. 8.
Figure 11:
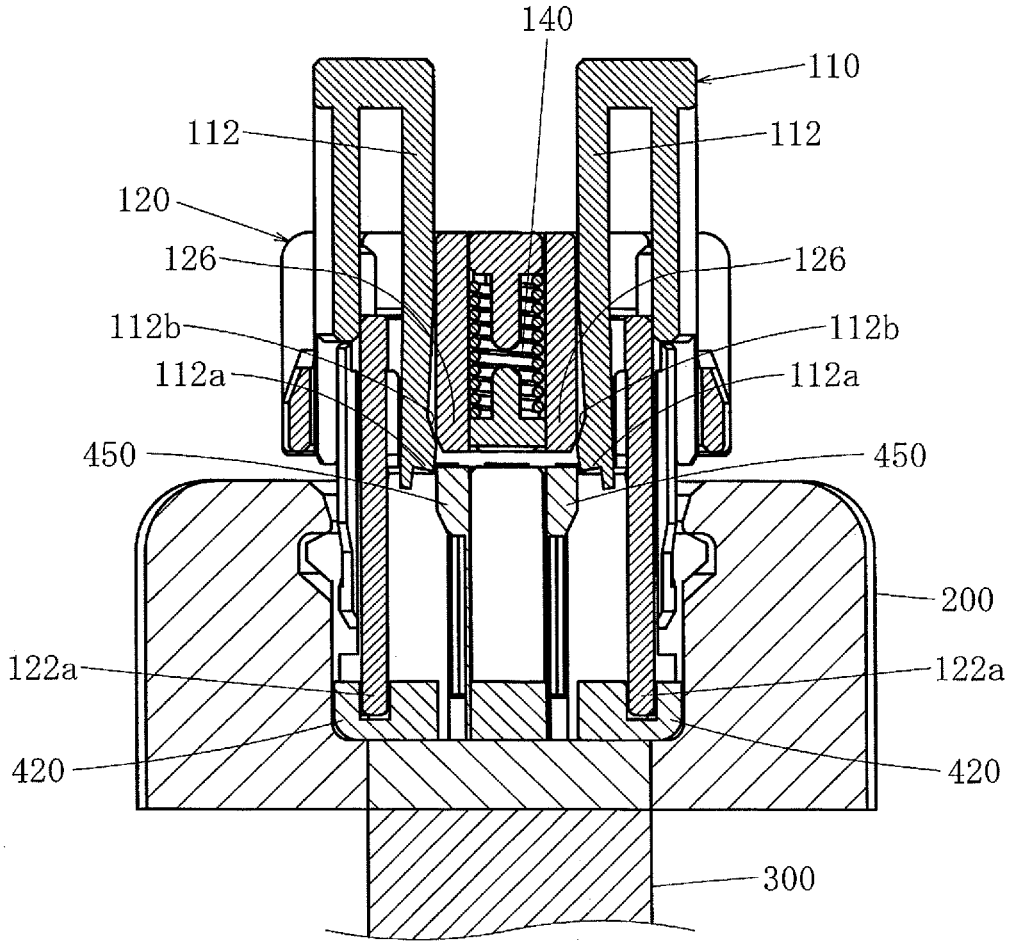
FIG. 11 is a diagram corresponding to FIG. 7. The state is the same as in FIG. 10. The abutting portions have moved away from the receiving faces, and the support member is being pressed toward the mating side due to being subjected to elastic restoring force from an elastic member.
Figure 13:
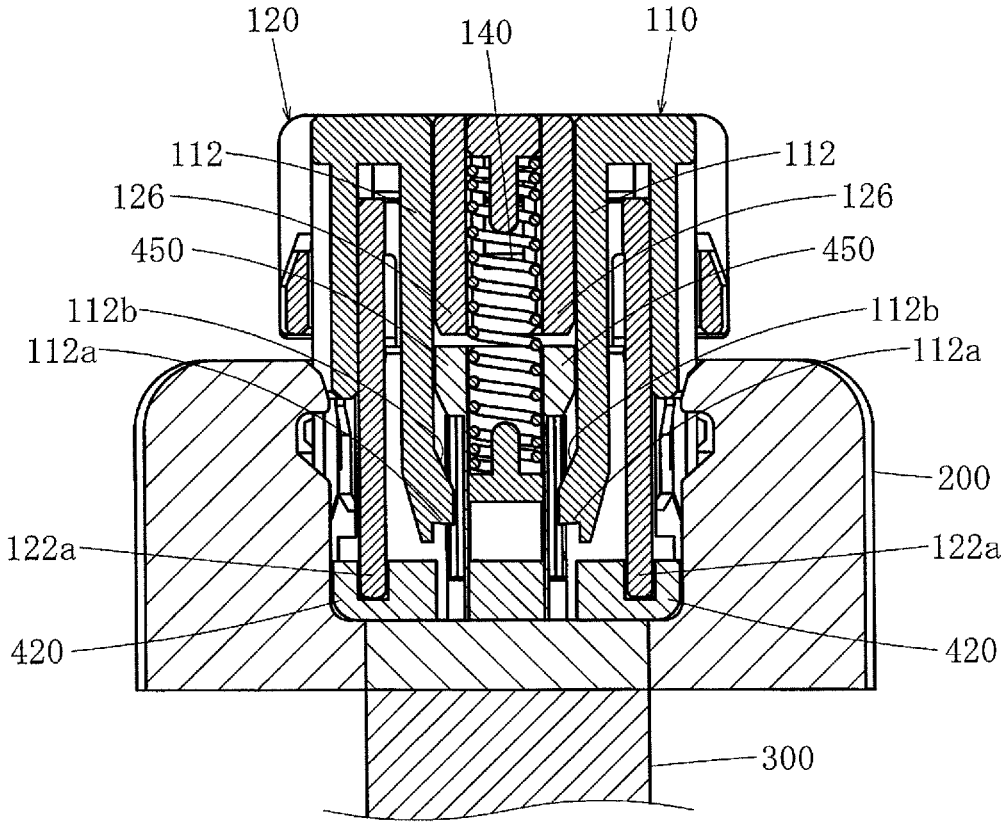
FIG. 13 is a diagram corresponding to FIG. 7. The state is the same as in FIG. 12.
Figure 14:
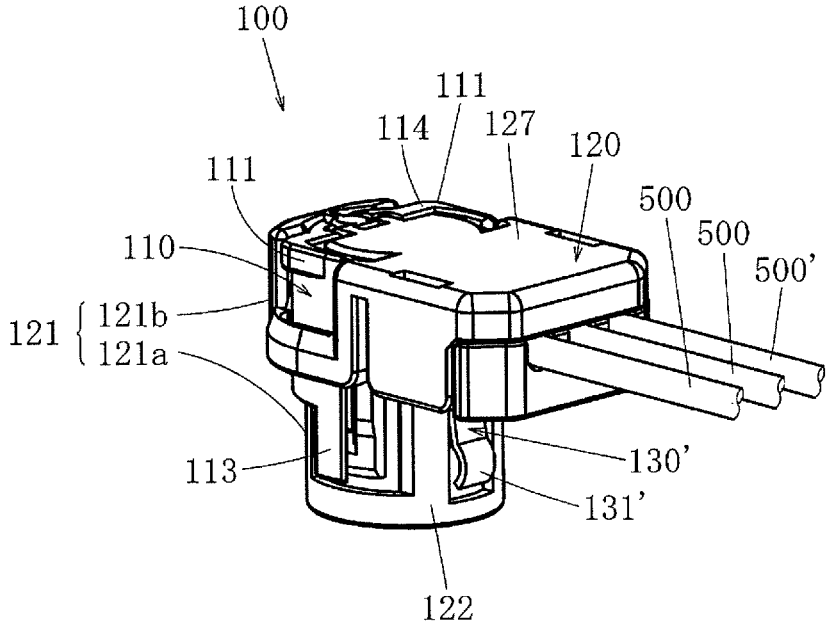
FIG. 14 is a perspective view of an electrical connector according to a variation.

As shown in FIGS. 3, 7, 9, 11, and 13, the elastic member 140 is provided between the support member 110 and the connector housing 120. The elastic member 140 is configured such that when it undergoes elastic deformation, the connector housing 120 is pressed toward the counter mating side relative to the support member 110 by the elastic restoring force. In the case of this embodiment, the elastic member 140 is a coil spring whose axis conforms to the mating direction and the counter mating direction and is provided so as to be sandwiched between the second member 121*b* of the housing body 121 and the support member 110. The elastic member 140 undergoes a certain degree of elastic deformation when the position of the connector housing 120 relative to the support member 110 is at the first position as shown in FIGS. 7 and 13. When the connector housing 120 is pressed in the mating direction from this position, the elastic member 140 is subjected to a compressive load and undergoes further elastic deformation (e.g., see FIG. 9), and the elastic member 140 undergoes the highest amount of elastic deformation when the second position is reached as shown in FIG. 11. In such a case, it is preferable that a stopper for locking the support member 110 and the connector housing 120 is provided so as to prevent the connector housing 120 from moving toward the counter mating side when its position relative to the support member 110 is at the first position. For this reason, the electrical connector 100 is provided with stoppers for restricting the position of the connector housing 120 relative to the support member 110 from moving farther toward the counter mating side than the first position. Specifically, as shown in FIG. 4, stoppers are provided on corresponding portions of the support member 110 and the connector housing 120. A first projection portion 115 that projects toward the connector housing 120 is provided on the aforementioned portion of the support member 110, and a second projection portion 128 that projects toward the support member 110 is provided on the aforementioned portion of the connector housing 120. When the position of the connector housing 120 relative to the support member 110 is at the first position, the first projection portion 115 and the second projection portion 128 come into contact with each other along the mating direction and the counter mating direction, and thus, the connector housing 120 is restricted from moving farther toward the counter mating side than the first position. As a result of providing these stoppers, even if the elastic member 140 undergoes a certain degree of elastic deformation and exerts elastic restoring force when the position of the connector housing 120 relative to the support member 110 is at the first position, the connector housing 120 does not move farther toward the counter mating side than the first position. However, the present invention includes an embodiment of the electrical connector in which these stoppers are not provided. One example of such an embodiment has a configuration in which the elastic member is disposed so as to be at its free length rather than undergoing elastic deformation when the position of the connector housing relative to the support member is at the first position. In the case of the present embodiment, the elastic member 140 is provided so as to undergo elastic deformation upon being subjected to a compressive load, but the elastic member may be provided so as to undergo elastic deformation upon being subjected to a tensile load. Also, the elastic member may be a flat spring, a volute spring, a torsion bar, or another type of spring that undergoes elastic deformation upon being subjected to a load, and the elastic member may be a plate-shaped member, a bar-shaped member, or a member having another shape that is made of a material that undergoes elastic deformation.

Figure 2:
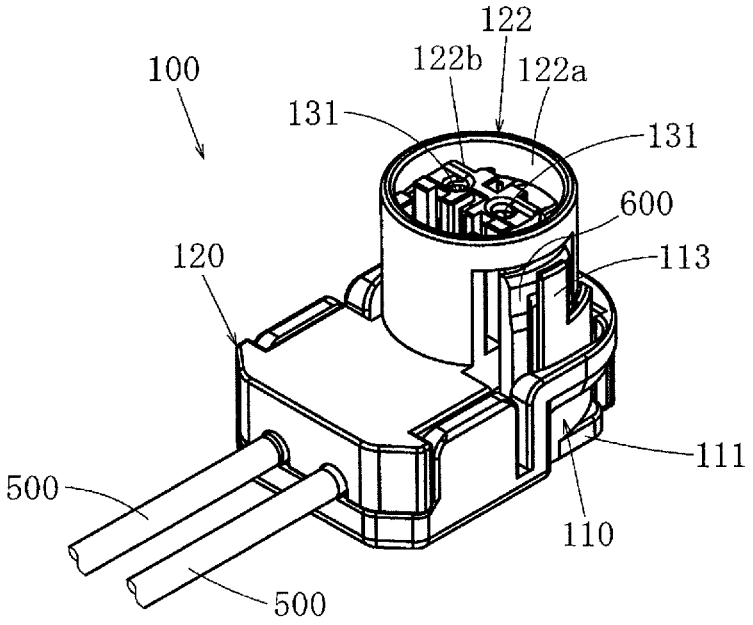
FIG. 2 is a perspective view of the electrical connector of the embodiment as viewed from the opposite side.

As shown in FIGS. 1 to 3, operation portions 111 that protrude away from the center of the support member 110 (i.e., outward) are provided on the counter mating side of the support member 110 so as to facilitate pinching by a hand, but the present invention includes an embodiment in which these operation portions are not provided on the support member. As shown in FIGS. 3, 7, 9, 11, and 13, flexible leg portions 112 are provided on the support member 110. The leg portions 112 extend toward the mating side. The leg portions 112 are bar-shaped and their end portions on the counter mating side are connected to the support member 110. However, the leg portions may be plate-shaped for example or have another shape, and an intermediate portion along the mating direction for example or another portion may be connected to the support member. In the case of the present embodiment, the leg portions 112 are formed from the same material as the support member 110 and are formed so as to be integrated with the support member 110, but the leg portions may be formed from a material that is the same as or different from the support member, and they may be connected to the support member, coupled thereto, or provided thereon by another method. The end portions of the leg portions 112 on the mating side are provided with abutting portions 112*a* that abut against receiving faces 451 of jutting portions 450 of the retainer 400. As shown in FIGS. 1, 7, 9, 11, and 13, the jutting portions 450 are provided on the retainer 400 so as to jut out laterally. Here, "laterally" refers to a direction included in a plane that is orthogonal to the mating direction or the counter mating direction. The jutting portions may be provided on the socket of the inflator housing. In this case, the jutting portions are provided so as to protrude from the wall of the socket toward the center of the socket. Also, it is preferable that the leg portions are provided on outer circumferential portions of the support member that are away from the center. The receiving face 451, which faces the mating side, is provided on the mating side of each of the jutting portions 450, the mating-side edge of a side face 452 that faces laterally is connected to the edge of the receiving face 451, and a corner portion 453 is formed by the receiving face 451 and the side face 452. As shown in FIGS. 3, 7, 9, 11, and 13, an abutting face 112*aa* that faces the mating side is provided on the mating side of each of the abutting portions 112*a*, the counter-mating-side edge of a side face 112*ab* that faces laterally is connected to the edge of the abutting face 112*aa*, and a corner portion 112*ac* is formed by the abutting face 112*aa* and the side face 112*ab*. While the leg portions 112 are in the free state of not being subjected to a load, when the abutting faces 112*aa* of the abutting portions 112*a* of the leg portions 112 are abutted against the receiving faces 451 of the jutting portions 450 of the retainer 400, the side faces 112*ab* of the abutting portions 112*a* of the leg portions 112 oppose the side faces 452 of the jutting portions 450 of the retainer 400, and the corner portions 112*ac* of the abutting portions 112*a* fit into the corner portions 453 of the jutting portions 450. However, it is sufficient that the abutting faces 112*aa* are provided on the abutting portions 112*a* of the leg portions 112, and a configuration is possible in which the side faces 112*ab* are not formed, and the corner portions 112*ac* are not formed. Also, it is sufficient that the receiving faces 451 are provided on the jutting portions 450 of the retainer 400, and a configuration is possible in which the side faces 452 are not formed, and the corner portions 453 are not formed.

As shown in FIGS. 7, 9, 11, and 13, the connector housing 120 is provided with a pressing portion 126. The pressing portion 126 is located laterally with respect to the leg portions 112 of the support member 110. In the case of the present embodiment, the pressing portion 126 is cylindrical so as to surround the elastic member 140, but the pressing portion may be plate-shaped or bar-shaped, or have another shape. A projection portion 112*b* that protrudes laterally is provided on a portion of each of the leg portions 112 that corresponds to a mating-side portion of the pressing portion 126 when the connector housing 120 is at the second position. Each of the projection portions 112*b* protrudes so as to approach the opposing leg portion 112. The projection portions 112*b* are provided so as to cut into the path along which the pressing portion 126 passes when the connector housing 120 moves from the first position to the second position. As shown in the progression from FIG. 7 to FIG. 9, and then to FIG. 11, as the connector housing 120 moves from the first position to the second position, the pressing portion 126 presses the projection portions 112*b* of the leg portions 112 laterally, and the leg portions 112 move away from the receiving faces 451. The faces of the projection portions 112*b* on the pressing portion 126 side are tilted so as to approach the pressing portion 126 as they extend toward the mating side such that the pressing portion 126 can easily move onto the projection portions 112*b*, but a configuration is possible in which instead of this, the end portions of the projection portions on the counter mating side are provided with faces that face the counter mating side. Also, a configuration is possible in which instead of or in addition to providing the leg portions with the projection portions, the pressing member protrudes laterally due to a copying mechanism or the like so as to press the leg portions laterally as the connector housing moves from the first position to the second position.

The electrical connector 100 is configured such that when the abutting portions 112*a* of the leg portions 112 of the support member 110 are abutted against the receiving faces 451 of the jutting portions 450 of the retainer 400, and the connector housing 120 at the first position is pressed toward the mating side, the elastic member 140 undergoes elastic deformation. If the connector housing 120 does not reach the second position, the connector housing 120 returns to the first position due to being pressed in the counter mating direction relative to the support member 110 by the elastic restoring force of the elastic member 140 (from the state shown in FIGS. 6 and 7 to the state shown in FIGS. 8 and 9). If the connector housing 120 reaches the second position, the abutting portions 112*a* move away from the receiving faces 451 due to being pressed by the pressing portions 126 (from the state shown in FIGS. 10 and 11 to the state shown in FIGS. 12 and 13), the support member 110 is pressed toward the mating side due to being subjected to the elastic restoring force of the elastic member 140, and the connector housing 120 becomes relatively positioned at the first position.

The electrical connector 100 is provided so as to be symmetrical about a line passing through the center of the electrical connector 100 when viewed in the mating direction or the counter mating direction. Accordingly, the operation portions 111 and the leg portions 112 of the support member 110, the guiding openings 123 and the pressing portions 126 of the connector housing 120, and the like are each provided as a pair, and the members of each pair are provided on respective sides of the line of symmetry. However, the structure and the shape of the electrical connector are not intended to be limited by this. For example, electrical connector may be provided so as to be asymmetrical about the aforementioned line, the support member may be provided with one or two or more operation portions, leg portions, and the like, and the connector housing may be provided with one or two or more guiding openings, pressing portions, and the like.

As shown in FIGS. 6 and 7, the contact portions 131 of the electrical terminals 130 are not in contact with the squib terminals 310 when the abutting portions 112*a* of the leg portions 112 of the support member 110 are abutted against the receiving faces 451 of the jutting portions 450 of the retainer 400 and furthermore the connector housing 120 is at the first position. Specifically, the contact portions 131 of the electrical terminals 130 and the squib terminals 310 are disposed so as to be separated from each other when the abutting portions 112*a* of the leg portions 112 of the support member 110 are abutted against the receiving faces 451 of the jutting portions 450 of the retainer 400, and furthermore, the connector housing 120 is at the first position. The contact portions 131 of the electrical terminals 130 come into contact with the squib terminals 310 when the connector housing 120 is then pressed toward the mating side from this state.

Figure 10:
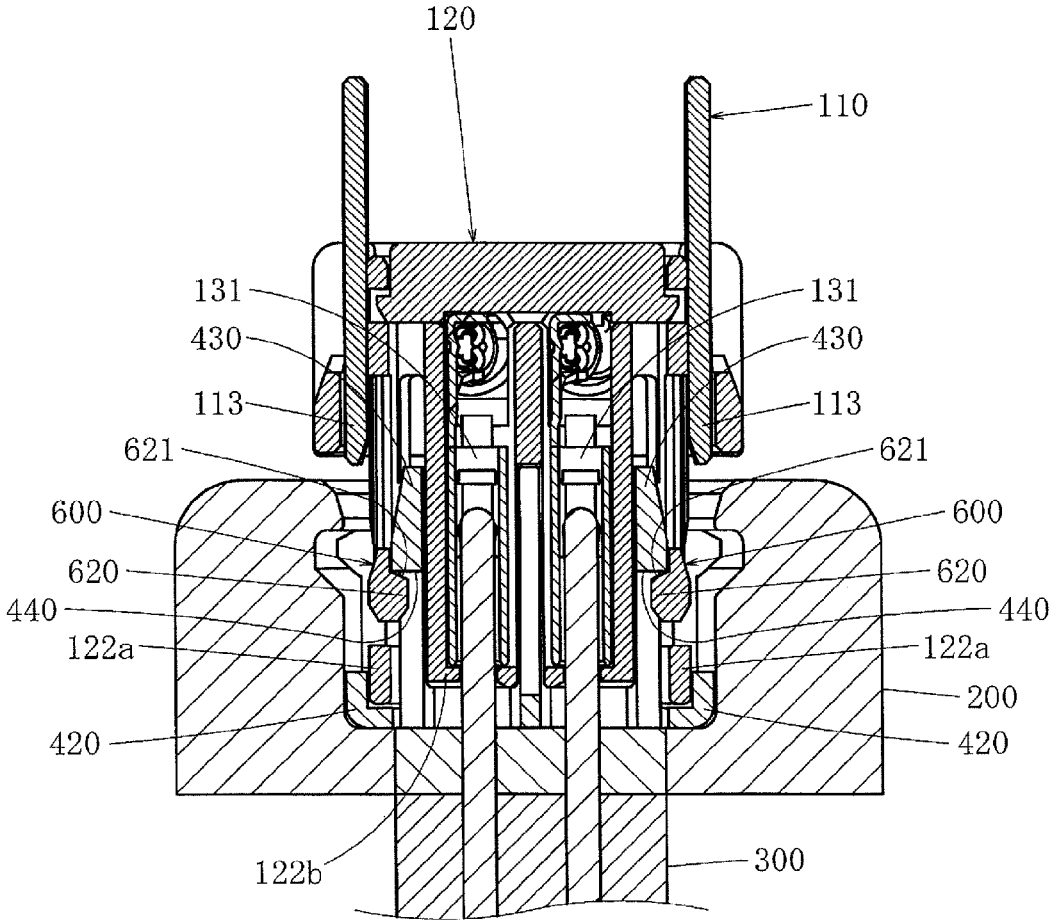
FIG. 10 is a diagram corresponding to FIG. 6. The state has changed from the state shown in FIGS. 8 and 9 to the state at the moment at which the connector housing has been pressed farther toward the mating side, and a mating portion of the connector housing has mated with the retainer. At this time, the projection portions of the lock arms are engaged with step portions of the retainer.
Figure 12:
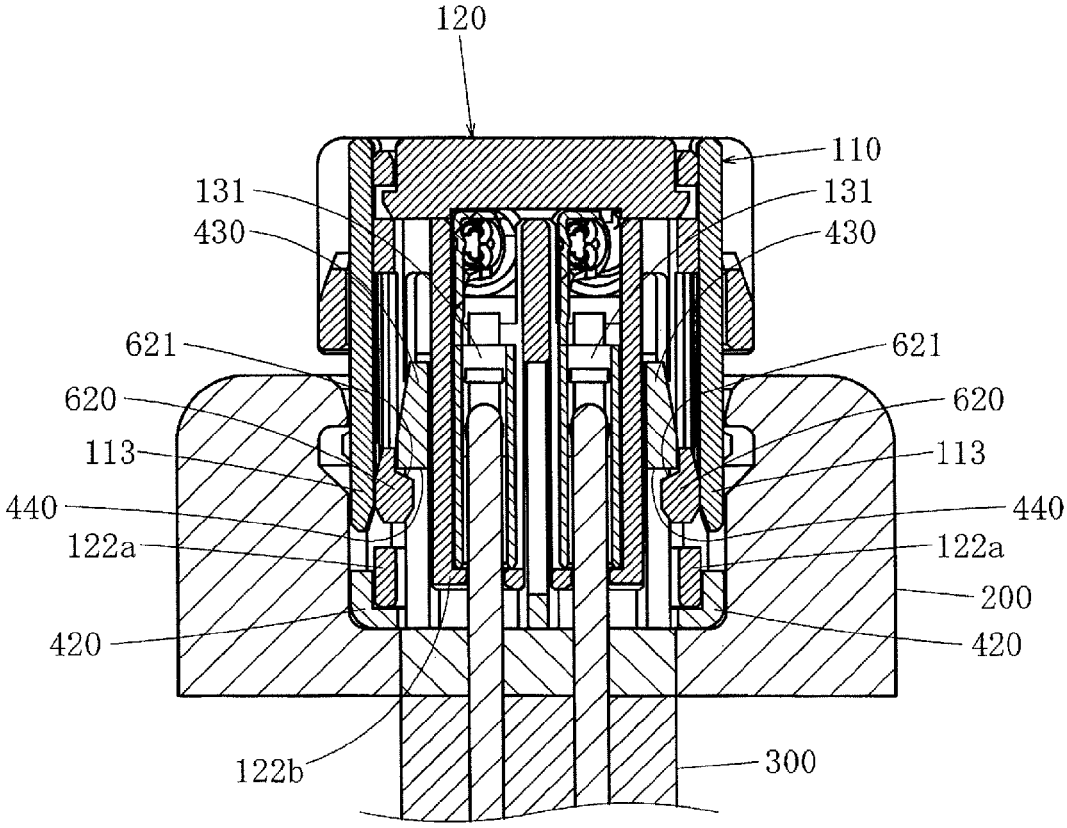
FIG. 12 is a diagram corresponding to FIG. 6. The state immediately after the state in FIGS. 10 and 11 is shown, the support member has been pressed toward mating side due to being subjected to elastic restoring force from the elastic member, and the connector housing is relatively positioned at the first position.

So as to return from the state shown in FIGS. 12 and 13 to the state shown in FIGS. 10 and 11, when the mating portion 122 of the connector housing 120 is mated to the retainer 400, if the support member 110 is moved toward the counter mating side so as to relatively position the connector housing 120 at the second position and cause the elastic member 140 to undergo elastic deformation, the connector housing 120 is pressed in the counter mating direction relative to the support member 110 due to the elastic restoring force of the elastic member 140. Then, so as to return from the state shown in FIGS. 8 and 9 to the state shown in FIGS. 6 and 7, the connector housing 120 moves from the second position to the first position, the abutting portions 112*a* move toward the counter mating side of the receiving faces 451 while passing alongside the jutting portions 450 due to the flexibility of the leg portions 112, and then the abutting portions 112*a* abut against the receiving faces 451.

In the case of the present embodiment, the connector housing 120 is provided with flexible lock arms 600 as shown in FIGS. 6, 8, 10, 12 and the like. Although two lock arms 600 are provided in this embodiment, one lock arm 600 may be provided, or three or more lock arms 600 may be provided. The lock arms 600 extend along the mating direction. The lock arms 600 are connected to the connector housing 120 via elastically deforming connection portions 610 so as to be able to tilt about an axis X that extends along a direction that is orthogonal to the mating direction or the counter mating direction. The axis X is a virtual axis. In the case of this embodiment, the lock arms 600 are connected to the housing body 121 via the connection portions 610 so as to be able to tilt about the axis X, but the lock arms may be connected to the mating portion via the connection portions so as to be able to tilt about the axis.

Figure 15:
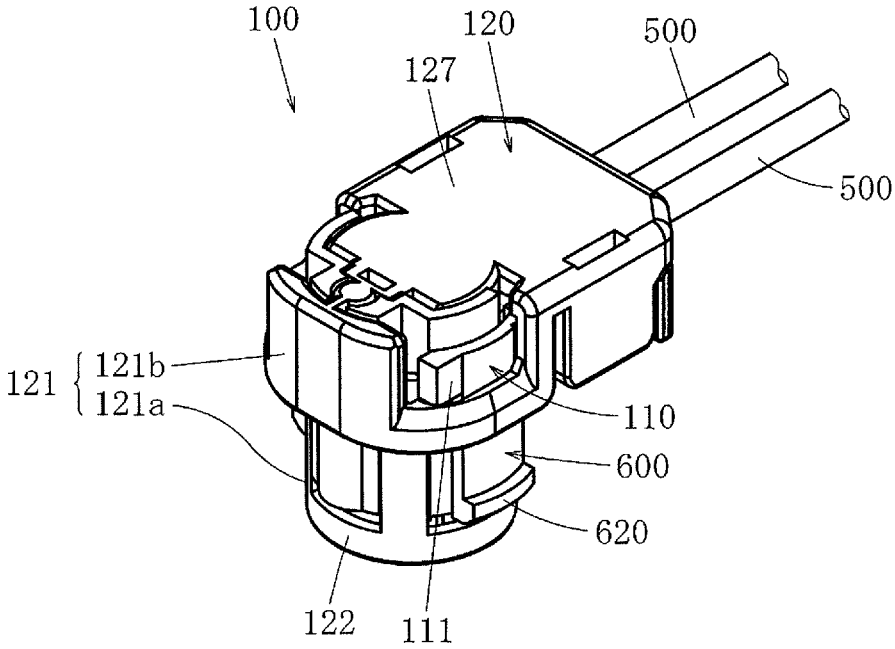
FIG. 15 is a perspective view of an electrical connector according to another variation.

Projection portions 620 are provided on mating-side end portions of the lock arms 600 that are on the mating side relative to the connection portions 610. The projection portions 620 are provided on the inner side of the lock arms 600. When viewing the lock arms 600 in the mating direction, the inner side of the lock arms 600 is the side that is close to the center of the housing body 121, and the outer side is the side opposite to the inner side. With this configuration, as the mating portion 122 is fitted into the retainer 400 in the mating direction, the projection portions 620 ride over the wall of the retainer 400 and then engage with step portions 440 of the retainer 400, and as the mating portion 122 is pulled out from the retainer 400 in the counter mating direction, the projection portions 620 move away from the step portions 440 and ride over the wall of the retainer 400. FIG. 15 shows a variation of the electrical connector 100. In the case of this electrical connector 100, the projection portions 620 are provided on the outer side of the lock arms 600. With this configuration, as the mating portion 122 is fitted into the retainer 400, the projection portions 620 ride over the wall 211 of the socket 210 and then engage with a step portion of the socket 210, and as the mating portion 122 is pulled out from the retainer 400 in the counter mating direction, the projection portions 620 move away from the step portion and ride over the wall 211 of the socket 210. The step portion of the socket 210 is the mating-side edge of the above-described groove 212, for example, but may be formed separately. Other aspects of the configuration are similar to the electrical connector of the present embodiment. The end portions of the lock arms that are on the counter mating side relative to the connection portions may be used as operation portions. In this case, when the operation portions of the lock arms are pressed so as to tilt the lock arms with the connection portions serving as the fulcrum, the projection portions move away from the step portion, and the mating portion is pulled out from the retainer in the counter mating direction in this state. The same follows for the above-described variation in which the projection portions project outward on the lock arms.

Faces 621 on the counter mating side of the projection portions 620 of the lock arms 600 are provided so as to be tilted so as to approach the mating side as they extend toward the tip of the projection portions 620, that is to say, as they extend toward the inner side of the lock arms 600. According to this configuration, the projection portions 620 are easily moved away from the step portions 440 when the connector housing 120 is pulled out in the counter mating side in order to return from the state shown in FIGS. 10 and 11 to the state shown in FIGS. 8 and 9. In the above-described variation in which the projection portions 620 project outward on the lock arms 600, the faces 621 on the counter mating side of the projection portions 620 need only be provided so as to be tilted so as to approach the mating side as they extend toward the tip of the projection portions 620, that is to say, as they extend toward the outer side of the lock arms 600. Instead of or in addition to tilting the faces 621 on the counter mating side of the projection portions 620 of the lock arms 600 in this way, the faces of the step portions 440 of the retainer 400 that face the counter mating side may be provided so as to be tilted so as to approach the mating side as they extend toward the outer side of the retainer 400. Similarly, in the above-described variation in which the projection portions 620 project outward on the lock arms 600, the face of the step portion of the socket that faces the counter mating side may be provided so as to be tilted so as to approach the mating side as it extends toward the inner side of the socket. However, this configuration does not need to be applied in cases such as when the mating portion of the connector housing 120 is permanently fitted to the retainer by preventing the projection portions from moving away from the step portions.

When the mating portion 122 of the connector housing 120 is mated to the retainer 400, the projection portions 620 of the lock arm 600 engage with the step portions 440. Similarly, if the step portion is provided on the socket, when the mating portion of the connector housing is mated to the retainer, the projection portions of the lock arms engage with the step portion of the socket.

As shown in FIGS. 3, 6, 8, 10, and 12, the support member 110 is provided with restriction portions 113 that oppose the back face of the projection portions 620 of the lock arms 600 when the connector housing 120 is at the first position, and that prevent the projection portions 620 from moving away from the step portions 440 when the mating portion 122 of the connector housing 120 has been mated to the retainer 400. The restriction portions 113 are plate-shaped and extend toward the mating side from end portions on the mating side of the support member 110, but the shape of the restriction portions is not limited to this, and they may be bar-shaped or have another shape. Also, the restriction portions may be provided on a portion other than the end portions on the mating side of the support member. When viewed in the mating direction, the restriction portions 113 are provided on the side of the lock arms 600 that is away from the center of the connector housing 120. If the restriction portions are provided in the above-described variation in which the projection portions 620 project outward on the lock arms 600, the restriction portions are provided on the side of the lock arms 600 that is closer to the center of the connector housing 120 when viewed in the mating direction.

As shown in FIGS. 1, 6, 7, 12, and 13, an end face 114 on the counter mating side of the support member 110 and an end face 127 on the counter mating side of the connector housing 120 are provided so as to be flush with each other when the connector housing 120 is at the first position. Similarly, also in the case of the above-described variation shown in FIG. 14 in which another electrical terminal 130' is provided, the end face 114 on the counter mating side of the support member 110 and the end face 127 on the counter mating side of the connector housing 120 are provided so as to be flush with each other when the connector housing 120 is at the first position. Similarly, in the case of the above-described variation shown in FIG. 15 in which the projection portions 620 project outward on the lock arms 600, the end face on the counter mating side of the support member and the end face on the counter mating side of the connector housing may be provided so as to be flush with each other when the connector housing is at the first position, although this is not the configuration here.

Electrical connectors of this type are sometimes provided with a shorting part. Specifically, a shorting part for shorting the squib terminals is provided in order to prevent, for example, malfunction of the squib due to current or the like flowing between the pair of squib terminals before the electrical connector is mated. In this case, for example, when the electrical connector is mated to the retainer, the shorting terminal is pressed outward and away due to being subject to force from the electrical connector, and thus, canceling the shorting. Although this shorting part is not provided in the squib connection device of the above-described embodiment, an embodiment of the squib connection device in which the squib connection device of the above-described embodiment includes the shorting part is included as an embodiment of the squib connection device of the present invention.

Accordingly, with the electrical connector 100 of the above-described embodiment, in the case where the abutting portions 112*a* of the leg portions 112 of the support member 110 are abutted against the receiving faces 451 of the jutting portions 450 of the retainer 400, and the connector housing 120 at the first position is pressed toward the mating side, the mating portion 122 of the connector housing 120 is not mated to the retainer 400 until the connector housing 120 reaches the second position. When the connector housing 120 reaches the second position, the mating portion 122 of the connector housing 120 is mated to the retainer 400, and the connector housing 120 is relatively positioned at the first position. In this way, the position of the connector housing 120 relative to the support member 110 is used to check whether or not the mating portion 122 of the connector housing 120 has been mated to the retainer 400, thus facilitating the prevention of incomplete mating of the mating portion 122 of the connector housing 120 to the retainer 400. Also, the retainer 400 has a simple structure since the retainer 400 does not have members corresponding to the locking arms of the above-described patent document.

When the mating portion 122 of the connector housing 120 is to be mated to the retainer 400, the connector housing 120 is pressed toward the mating side, and when the connector housing 120 is mated to the retainer 400, the support member 110 is pressed toward the mating side. For this reason, the operator cannot select from various patterns of operational content, such as first pressing the connector housing 120 toward the mating side and then pressing the support member 110 toward the mating side, or first pressing the support member 110 toward the mating side and then pressing the connector housing 120 toward the mating side, or pressing both at the same time. This results in a small risk of incomplete mating due to differences in operational content.

In this way, before the mating portion 122 of the connector housing 120 is mated to the retainer 400 and the electrical terminals 130 come into contact with the squib terminals 310, the connector housing 120 is pressed toward the counter mating side by the elastic restoring force of the elastic member 140 that is provided between the connector housing 120 and the support member 110. When mating is complete, the support member 110 is moved toward the mating side by the elastic restoring force of the elastic member 140, thus making it possible to prevent incomplete mating and to give the retainer 400 a simple structure by omitting members corresponding to the locking arms of the above-described patent document from the retainer 400.

In the electrical connector of the present invention, it is sufficient that the contact portions of the electrical terminals and the squib terminals are in contact with each other at least when the mating portion of the connector housing has been mated to the retainer, and the contact portions of the electrical terminals and the squib terminals are separated from each other when the mating portion of the connector housing has been separated from the retainer. Among various embodiments, the electrical connector 100 of the embodiment and the variations that are described above is configured such that the contact portions 131 of the electrical terminals 130 are not in contact with the squib terminals 310 when the abutting portions 112*a* of the leg portions 112 of the support member 110 are abutted against the receiving faces 451 of the jutting portions 450 of the retainer 400, and furthermore, the connector housing 120 is at the first position. If the mating portion 122 of the connector housing 120 is not completely mated to the retainer 400, the connector housing 120 is pressed toward the counter mating side by the elastic restoring force of the elastic member 140 so as to return to the first position. In this case, if the above-described configuration is applied, the contact portions 131 of the electrical terminals 130 will not be in contact with the squib terminals 310, thus preventing the squibs 300 from inadvertently receiving electrical energy from the electrical connector 100. This also makes it possible to not provide the retainer or the like with the above-described shorting parts. In this way, the elastic member 140 undergoes elastic deformation when the electrical terminals 130 of the electrical connector 100 begin to come into contact with the squib terminals 310, thus making it possible to prevent a situation in which the electrical terminals 130 and the squib terminals 310 are electrically connected to each other regardless of the fact that the mating of the electrical connector 100 to the partner member is incomplete.

With the electrical connector of the present invention, in the case where the mating portion of the connector housing has been mated to the retainer, and then the mating portion of the connector housing is to be removed from the retainer, there is no limitation on which of two operations is performed first, namely the operation of moving the connector housing toward the counter mating side or the operation of moving the support member toward the counter mating side. Among various embodiments, the electrical connector 100 of the embodiment and the variations that are described above is configured such that if the mating portion 122 of the connector housing 120 has been mated to the retainer 400, and then the support member 110 is moved toward the counter mating side so as to relatively position the connector housing 120 at the second position and cause the elastic member 140 to undergo elastic deformation, the connector housing 120 is pressed in the counter mating direction relative to the support member 110 by the elastic restoring force of the elastic member 140 such that the connector housing 120 moves from the second position to the first position, the abutting portions 112*a* move toward the counter mating side of the receiving faces 451 while passing alongside the jutting portions 450 due to the flexibility of the leg portions 112, and then the abutting portions 112*a* abut against the receiving faces 451. According to this configuration, the connector housing 120 becomes separated from the retainer 400 due to the support member 110 moving toward the counter mating side.

The electrical connector of the present invention includes an embodiment in which the lock arms are not provided. Among various embodiments, the electrical connector 100 of the embodiment and the variations that are described above is configured such that the flexible lock arms 600 extend from the connector housing 120 in the mating direction, the end portions on the mating side of the lock arms 600 are provided with projection portions 620 that, as the mating portion 122 is fitted to the retainer 400, ride over the wall of the retainer 400 or the socket and then engage with the step portions 440 of the retainer 400 or the socket and also move away from the step portions 440 when the lock arms 600 undergo flexure, and the projection portions 620 engage with the step portions 440 when the mating portion 122 of the connector housing 120 is mated to the retainer 400. According to this configuration, when the mating portion 122 of the connector housing 120 is mated to the retainer 400, the projection portions 620 engage with the step portions 440, thus maintaining the state in which the connector housing 120 is mated to the retainer 400.

The electrical connector of the present invention includes an embodiment in which the restriction portions are not provided. Among various embodiments, the electrical connector 100 of the embodiment and the variations that are described above is configured such that the support member 110 is provided with the restriction portions 113 that oppose the back face of the projection portions 620 of the lock arms 600 when the connector housing 120 is at the first position, and that prevent the projection portions 620 from moving away from the step portions 440 when the mating portion 122 of the connector housing 120 has been mated to the retainer 400. According to this configuration, when the mating portion 122 of the connector housing 120 is mated to the retainer 400, the separation of the projection portions 620 from the step portions 440 is prevented by the restriction portions 113, thus maintaining the state in which the connector housing 120 is mated to the retainer 400.

In the electrical connector of the present invention, there is no limitation on the relative positional relationship between the position of the support member and the position of the connector housing when the connector housing is at the first position. Among various embodiments, the electrical connector 100 of the embodiment and the variations that are described above is configured such that the end face 114 on the counter mating side of the support member 110 and the end face 127 on the counter mating side of the connector housing 120 are provided so as to be flush with each other when the connector housing 120 is at the first position. According to this configuration, when an attempt is made to mate the connector housing 120 to the retainer 400, and also when the connector housing 120 has been mated to the retainer 400, for example, the end face 114 on the counter mating side of the support member 110 and the end face 127 on the counter mating side of the connector housing 120 are flush with each other, thus making it unlikely to have problems such as interference with a harness or the like on the counter mating side of the connector housing 120 or the support member 110, and the connector housing 120 or the support member 110 becoming damaged.

A squib connection device of the present invention is also sufficiently disclosed through the above description. Specifically, a squib connection device of the present invention includes: a partner device that has an inflator housing 200 provided with a socket 210 that is recessed toward a counter mating side from a surface on a mating side, a squib 300 provided on the counter mating side of the inflator housing 200 such that a squib terminal 310 rises up toward the mating side from a bottom portion of the socket 210, a retainer 400 that is attached to the socket 210, and an electrical connector 100 that can be mated to the partner device. The electrical connector 100 includes a support member 110, a connector housing 120 that has a mating portion 122 capable of being mated to the retainer 400 and that is provided such that the position of the connector housing 120 relative to the support member 110 can move between a first position and a second position that is on the mating side relative to the first position, an electrical terminal 130 that is provided in the connector housing 120 and has a contact portion 131 that can come into contact with the squib terminal 310 at least when the mating portion 122 of the connector housing 120 is mated to the retainer 400, and an elastic member 140 that is provided between the support member 110 and the connector housing 120 and presses the connector housing 120 toward the counter mating side relative to the support member 110 using elastic restoring force, wherein the support member 110 is provided with a flexible leg portion 112 that extends toward the mating side, an end portion on the mating side of the leg portion 112 being provided with an abutting portion 112*a* capable of abutting against a receiving face 451 formed on the mating side of a jutting portion 450 that is provided on the retainer 400 so as to jut out laterally, the connector housing 120 is provided with a pressing portion 126 that presses the leg portion 112 laterally such that the leg portion 112 moves away from the receiving face 451 when the connector housing 120 moves from the first position to the second position, and when the abutting portion 112*a* of the leg portion 112 of the support member 110 is abutted against the receiving face 451 of the jutting portion 450 of the retainer 400, and the connector housing 120 at the first position is pressed toward the mating side, the elastic member 140 undergoes elastic deformation. If the connector housing does not reach the second position, the connector housing 120 returns to the first position due to being pressed in the counter mating direction relative to the support member 110 by elastic restoring force of the elastic member, and if the connector housing 120 reaches the second position, the abutting portion 112*a* moves away from the receiving face 451 due to being pressed by the pressing portion 126, the support member 110 is pressed toward the mating side due to being subjected to elastic restoring force of the elastic member 140, and the connector housing 120 becomes relatively positioned at the first position.

With the electrical connector 100 of the above-described embodiment, in the case where the abutting portions 112*a* of the leg portions 112 of the support member 110 are abutted against the receiving faces 451 of the jutting portions 450 of the retainer 400, and the connector housing 120 at the first position is pressed toward the mating side, the mating portion 122 of the connector housing 120 is not mated to the retainer 400 until the connector housing 120 reaches the second position, and then when the connector housing 120 reaches the second position, the mating portion 122 of the connector housing 120 is mated to the retainer 400, and the connector housing 120 is relatively positioned at the first position. In this way, the position of the connector housing 120 relative to the support member 110 is used to check whether or not the mating portion 122 of the connector housing 120 has been mated to the retainer 400, thus facilitating the prevention of incomplete mating of the mating portion 122 of the connector housing 120 to the retainer 400. Also, the retainer 400 has a simple structure since the retainer 400 does not have members corresponding to the locking arms of the above-described patent document.

When the mating portion 122 of the connector housing 120 is to be mated to the retainer 400, the connector housing 120 is pressed toward the mating side, and when the connector housing 120 is mated to the retainer 400, the support member 110 is pressed toward the mating side. For this reason, the operator cannot select from various patterns of operational content, such as first pressing the connector housing 120 toward the mating side and then pressing the support member 110 toward the mating side, or first pressing the support member 110 toward the mating side and then pressing the connector housing 120 toward the mating side, or pressing both at the same time. This results in a small risk of incomplete mating due to differences in operational content.

In this way, with this squib connection device, before the mating portion 122 of the connector housing 120 is mated to the retainer 400 and the electrical terminals 130 come into contact with the squib terminals 310, the connector housing 120 is pressed toward the counter mating side by the elastic restoring force of the elastic member 140 that is provided between the connector housing 120 and the support member 110, and when mating is complete, the support member 110 is moved toward the mating side by the elastic restoring force of the elastic member 140, thus making it possible to prevent incomplete mating and to give the retainer 400 a simple structure by omitting members corresponding to the locking arms of the above-described patent document from the retainer 400.

An overview of embodiments of the present invention will be described below.

1) An electrical connector according to a first aspect of the present invention includes:

a support member;

a connector housing that has a mating portion capable of being mated to a retainer attached to a socket that is recessed toward a counter mating side from a surface of an inflator housing on a mating side, and that is provided such that the position of the connector housing relative to the support member can move between a first position and a second position that is on the mating side relative to the first position;

an electrical terminal that is provided in the connector housing and has a contact portion that can come into contact with a squib terminal rising up toward the mating side from a bottom portion of the socket at least when the mating portion of the connector housing is mated to the retainer; and an elastic member that is provided between the support member and the connector housing and presses the connector housing toward the counter mating side relative to the support member using elastic restoring force, wherein the support member is provided with a flexible leg portion that extends toward the mating side, an end portion on the mating side of the leg portion being provided with an abutting portion capable of abutting against a receiving face formed on the mating side of a jutting portion that is provided on the retainer so as to jut out laterally, wherein the connector housing is provided with a pressing portion that presses the leg portion laterally such that the leg portion moves away from the receiving face when the connector housing moves from the first position to the second position, and wherein when the abutting portion of the leg portion of the support member is abutted against the receiving face of the jutting portion of the retainer, and the connector housing at the first position is pressed toward the mating side, the elastic member undergoes elastic deformation, and if the connector housing does not reach the second position, the connector housing returns to the first position due to being pressed in the counter mating direction relative to the support member by elastic restoring force of the elastic member, and if the connector housing reaches the second position, the abutting portion moves away from the receiving face due to being pressed by the pressing portion, the support member is pressed toward the mating side due to being subjected to elastic restoring force of the elastic member, and the connector housing becomes relatively positioned at the first position.

In the case where the abutting portion of the leg portion of the support member is abutted against the receiving face of the jutting portion of the retainer, and the connector housing at the first position is pressed toward the mating side, the mating portion of the connector housing is not mated to the retainer until the connector housing reaches the second position, and then when the connector housing reaches the second position, the mating portion of the connector housing is mated to the retainer, and the connector housing is relatively positioned at the first position. In this way, the position of the connector housing relative to the support member is used to check whether or not the mating portion of the connector housing has been mated to the retainer, thus facilitating the prevention of incomplete mating of the mating portion of the connector housing to the retainer. Also, the retainer has a simple structure since the retainer does not have members corresponding to the locking arms of the above-described patent document.

When the mating portion of the connector housing is to be mated to the retainer, the connector housing is pressed toward the mating side, and when the connector housing is mated to the retainer, the support member is pressed toward the mating side. For this reason, the operator cannot select from various patterns of operational content, such as first pressing the connector housing toward the mating side and then pressing the support member toward the mating side, first pressing the support member toward the mating side and then pressing the connector housing toward the mating side, or pressing both at the same time. This results in little risk of incomplete mating due to differences in operational content.

With the electrical connector according to the first aspect, it is possible to provide an electrical connector in which before the mating portion of the connector housing is mated to the retainer and the electrical terminal comes into contact with the squib terminal, the connector housing is pressed toward the counter mating side by the elastic restoring force of the elastic member that is provided between the connector housing and the support member, and when mating is complete, the support member is moved toward the mating side by the elastic restoring force of the elastic member, thus making it possible to prevent incomplete mating and to give the retainer a simple structure by omitting members corresponding to the locking arms of the above-described patent document from the retainer.

2) An electrical connector according to a second aspect of the present invention is the electrical connector according to the first aspect, wherein the contact portion of the electrical terminal is not in contact with the squib terminal when the abutting portion of the leg portion of the support member is abutted against the receiving face of the jutting portion of the retainer and furthermore the connector housing is at the first position.

If the mating portion of the connector housing is not completely mated to the retainer, the connector housing is pressed toward the counter mating side by the elastic restoring force of the elastic member so as to return to the first position. In this case, if the above-described configuration is applied, the contact portions of the electrical terminals will not be in contact with the squib terminals, thus preventing the squibs from inadvertently receiving electrical energy from the electrical connector. This also makes it possible to not provide the retainer or the like with the above-described shorting parts.

The electrical connector according to the second aspect obtains the effects obtained by the electrical connector according to the first aspect, and additionally, the elastic member undergoes elastic deformation when the electrical terminal of the electrical connector begins to come into contact with the squib terminal, thus making it possible to prevent a situation in which the electrical terminal and the squib terminal are electrically connected to each other regardless of the fact that the mating of the electrical connector to the partner member is incomplete.

3) An electrical connector according to a third aspect of the present invention is the electrical connector according to the first aspect or the electrical connector according to the second aspect, wherein when the mating portion of the connector housing is mated to the retainer, if the support member is moved toward the counter mating side so as to relatively position the connector housing at the second position and cause the elastic member to undergo elastic deformation, the connector housing is pressed in the counter mating direction relative to the support member due to elastic restoring force of the elastic member, the connector housing moves from the second position to the first position, the abutting portion moves toward the counter mating side of the receiving face while passing alongside the jutting portion due to the flexibility of the leg portion, and then the abutting portion abuts against the receiving face.

According to this configuration, the connector housing becomes separated from the retainer due to the support member moving toward the counter mating side.

The electrical connector according to the third aspect obtains the effects obtained by the electrical connector according to the first or second aspect, and additionally, the connector housing can be separated from the retainer by moving the support member toward the counter mating side.

4) An electrical connector according to a fourth aspect of the present invention is the electrical connector according to any one of the first to third aspects, wherein a flexible lock arm extends in the mating direction from the connector housing, an end portion on the mating side of the lock arm is provided with a projection portion that, as the mating portion is fitted to the retainer, rides over a wall of the retainer or the socket and then engages with a step portion of the retainer or the socket, and also moves away from the step portion when the lock arm undergoes flexure, and the projection portion engages with the step portion when the mating portion of the connector housing is mated to the retainer.

According to this configuration, when the mating portion of the connector housing is mated to the retainer, the projection portion engages with the step portion, thus maintaining the state in which the connector housing is mated to the retainer.

The electrical connector according to the fourth aspect obtains the effects obtained by the electrical connector according to any one of the first to third aspects, and additionally, when the mating portion of the connector housing is mated to the retainer, the projection portion engages with the step portion, thus making it possible to maintain the state in which the connector housing is mated to the retainer.

5) An electrical connector according to a fifth aspect of the present invention is the electrical connector according to the fourth aspect, wherein the support member is provided with a restriction portion that opposes a back face of the projection portion of the lock arm when the connector housing is at the first position, and that prevents the projection portion from moving away from the step portion when the mating portion of the connector housing has been mated to the retainer.

According to this configuration, when the mating portion of the connector housing is mated to the retainer, the separation of the projection portion from the step portion is prevented by the restriction portion, thus maintaining the state in which the connector housing is mated to the retainer.

The electrical connector according to the fifth aspect obtains the effects obtained by the electrical connector according to the fourth aspect, and additionally, when the mating portion of the connector housing is mated to the retainer, the separation of the projection portion from the step portion can be prevented by the restriction portion, thus making it possible to maintain the state in which the connector housing is mated to the retainer.

6) An electrical connector according to a sixth aspect of the present invention is the electrical connector according to any one of the first to fifth aspects, wherein an end face on the counter mating side of the support member and an end face on the counter mating side of the connector housing are provided so as to be flush with each other when the connector housing is at the first position.

According to this configuration, when an attempt is made to mate the connector housing to the retainer, and also when the connector housing has been mated to the retainer, for example, the end face on the counter mating side of the support member and the end face on the counter mating side of the connector housing are flush with each other, thus making it unlikely to have problems such as interference with a harness or the like on the counter mating side of the connector housing or the support member, and the connector housing or the support member becoming damaged.

The electrical connector according to the sixth aspect obtains the effects obtained by the electrical connector according to any one of the first to fifth aspects, and additionally, when an attempt is made to mate the connector housing to the retainer, and also when the connector housing has been mated to the retainer, for example, it is possible to make it unlikely to have problems such as interference with a harness or the like on the counter mating side of the connector housing or the support member, and the connector housing or the support member becoming damaged.

7) A squib connection device according to another aspect of the present invention includes:

a partner device including:

an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector that can be mated to the partner device, wherein the electrical connector includes:

a support member, a connector housing that has a mating portion capable of being mated to the retainer, and that is provided such that the position of the connector housing relative to the support member can move between a first position and a second position that is on the mating side relative to the first position, an electrical terminal that is provided in the connector housing and has a contact portion that can come into contact with the squib terminal at least when the mating portion of the connector housing is mated to the retainer, and an elastic member that is provided between the support member and the connector housing and presses the connector housing toward the counter mating side relative to the support member using elastic restoring force, wherein the support member is provided with a flexible leg portion that extends toward the mating side, an end portion on the mating side of the leg portion being provided with an abutting portion capable of abutting against a receiving face formed on the mating side of a jutting portion that is provided on the retainer so as to jut out laterally, wherein the connector housing is provided with a pressing portion that presses the leg portion laterally such that the leg portion moves away from the receiving face when the connector housing moves from the first position to the second position, and wherein when the abutting portion of the leg portion of the support member is abutted against the receiving face of the jutting portion of the retainer, and the connector housing at the first position is pressed toward the mating side, the elastic member undergoes elastic deformation, and if the connector housing does not reach the second position, the connector housing returns to the first position due to being pressed in the counter mating direction relative to the support member by elastic restoring force of the elastic member, and if the connector housing reaches the second position, the abutting portion moves away from the receiving face due to being pressed by the pressing portion, the support member is pressed toward the mating side due to being subjected to elastic restoring force of the elastic member, and the connector housing becomes relatively positioned at the first position.

In the case where the abutting portion of the leg portion of the support member is abutted against the receiving face of the jutting portion of the retainer, and the connector housing at the first position is pressed toward the mating side, the mating portion of the connector housing is not mated to the retainer until the connector housing reaches the second position, and then when the connector housing reaches the second position, the mating portion of the connector housing is mated to the retainer, and the connector housing is relatively positioned at the first position. In this way, the position of the connector housing relative to the support member is used to check whether or not the mating portion of the connector housing has been mated to the retainer, thus facilitating the prevention of incomplete mating of the mating portion of the connector housing to the retainer. Also, the retainer has a simple structure since the retainer does not have members corresponding to the locking arms of the above-described patent document.

When the mating portion of the connector housing is to be mated to the retainer, the connector housing is pressed toward the mating side, and when the connector housing is mated to the retainer, the support member is pressed toward the mating side. For this reason, the operator cannot select from various patterns of operational content, such as first pressing the connector housing toward the mating side and then pressing the support member toward the mating side, first pressing the support member toward the mating side and then pressing the connector housing toward the mating side, or pressing both at the same time. This results in a small risk of incomplete mating due to differences in operational content.

With the squib connection device according to the above aspect, it is possible to provide a squib connection device in which before the mating portion of the connector housing is mated to the retainer and the electrical terminal comes into contact with the squib terminal, the connector housing is pressed toward the counter mating side by the elastic restoring force of the elastic member that is provided between the connector housing and the support member, and when mating is complete, the support member is moved toward the mating side by the elastic restoring force of the elastic member, thus making it possible to prevent incomplete mating and to give the retainer a simple structure by omitting members corresponding to the locking arms of the above-described patent document from the retainer.

The electrical connector and the squib connection device of the present invention encompass embodiments that are combinations of features of the above-described embodiment and variations. Furthermore, the above-described embodiment and variations are merely several examples of the electrical connector and the squib connection device of the present invention. Accordingly, the electrical connector and the squib connection device of the present invention are not intended to be limited by the descriptions of the embodiment and variations.

The disclosure of Japanese Patent Application No. 2012-264804 filed on Dec. 3, 2012 including specification, drawings and claims is incorporated herein by reference in its entirety.

The invention claimed is:

1. An electrical connector comprising:

a support member;

a connector housing that has a mating portion capable of being mated to a retainer attached to a socket that is recessed toward a counter mating side from a surface of an inflator housing on a mating side, and that is provided such that the position of the connector housing relative to the support member can move between a first position and a second position that is on the mating side relative to the first position;

an electrical terminal that is provided in the connector housing and has a contact portion that can come into contact with a squib terminal rising up toward the mating side from a bottom portion of the socket at least when the mating portion of the connector housing is mated to the retainer; and an elastic member that is provided between the support member and the connector housing and presses the connector housing toward the counter mating side relative to the support member using elastic restoring force, wherein the support member is provided with a flexible leg portion that extends toward the mating side, an end portion on the mating side of the leg portion being provided with an abutting portion capable of abutting against a receiving face formed on the mating side of a jutting portion that is provided on the retainer so as to jut out laterally, wherein the connector housing is provided with a pressing portion that presses the leg portion laterally such that the leg portion moves away from the receiving face when the connector housing moves from the first position to the second position, and wherein when the abutting portion of the leg portion of the support member is abutted against the receiving face of the jutting portion of the retainer, and the connector housing at the first position is pressed toward the mating side, the elastic member undergoes elastic deformation, and if the connector housing does not reach the second position, the connector housing returns to the first position due to being pressed in the counter mating direction relative to the support member by elastic restoring force of the elastic member, and if the connector housing reaches the second position, the abutting portion moves away from the receiving face due to being pressed by the pressing portion, the support member is pressed toward the mating side due to being subjected to elastic restoring force of the elastic member, and the connector housing becomes relatively positioned at the first position.

2. The electrical connector according to claim 1, wherein the contact portion of the electrical terminal is not in contact with the squib terminal when the abutting portion of the leg portion of the support member is abutted against the receiving face of the jutting portion of the retainer and furthermore the connector housing is at the first position.

3. The electrical connector according to claim 1, wherein when the mating portion of the connector housing is mated to the retainer, if the support member is moved toward the counter mating side so as to relatively position the connector housing at the second position and cause the elastic member to undergo elastic deformation, the connector housing is pressed in the counter mating direction relative to the support member due to elastic restoring force of the elastic member, the connector housing moves from the second position to the first position, the abutting portion moves toward the counter mating side of the receiving face while passing alongside the jutting portion due to the flexibility of the leg portion, and the abutting portion abuts against the receiving face.

4. The electrical connector according to claim 2, wherein when the mating portion of the connector housing is mated to the retainer, if the support member is moved toward the counter mating side so as to relatively position the connector housing at the second position and cause the elastic member to undergo elastic deformation, the connector housing is pressed in the counter mating direction relative to the support member due to elastic restoring force of the elastic member, the connector housing moves from the second position to the first position, the abutting portion moves toward the counter mating side of the receiving face while passing alongside the jutting portion due to the flexibility of the leg portion, and then the abutting portion abuts against the receiving face.

5. The electrical connector according to claim 1, wherein a flexible lock arm extends in the mating direction from the connector housing, an end portion on the mating side of the lock arm is provided with a projection portion that, as the mating portion is fitted to the retainer, rides over a wall of the retainer or the socket and then engages with a step portion of the retainer or the socket, and also moves away from the step portion when the lock arm undergoes flexure, and the projection portion engages with the step portion when the mating portion of the connector housing is mated to the retainer.

6. The electrical connector according to claim 2, wherein a flexible lock arm extends in the mating direction from the connector housing, an end portion on the mating side of the lock arm is provided with a projection portion that, as the mating portion is fitted to the retainer, rides over a wall of the retainer or the socket and then engages with a step portion of the retainer or the socket, and also moves away from the step portion when the lock arm undergoes flexure, and the projection portion engages with the step portion when the mating portion of the connector housing is mated to the retainer.

7. The electrical connector according to claim 3, wherein a flexible lock arm extends in the mating direction from the connector housing, an end portion on the mating side of the lock arm is provided with a projection portion that, as the mating portion is fitted to the retainer, rides over a wall of the retainer or the socket and then engages with a step portion of the retainer or the socket, and also moves away from the step portion when the lock arm undergoes flexure, and the projection portion engages with the step portion when the mating portion of the connector housing is mated to the retainer.

8. The electrical connector according to claim 4, wherein a flexible lock arm extends in the mating direction from the connector housing, an end portion on the mating side of the lock arm is provided with a projection portion that, as the mating portion is fitted to the retainer, rides over a wall of the retainer or the socket and then engages with a step portion of the retainer or the socket, and also moves away from the step portion when the lock arm undergoes flexure, and the projection portion engages with the step portion when the mating portion of the connector housing is mated to the retainer.

9. The electrical connector according to claim 5, wherein the support member is provided with a restriction portion that opposes a back face of the projection portion of the lock arm when the connector housing is at the first position, and that prevents the projection portion from moving away from the step portion when the mating portion of the connector housing has been mated to the retainer.

10. The electrical connector according to claim 6, wherein the support member is provided with a restriction portion that opposes a back face of the projection portion of the lock arm when the connector housing is at the first position, and that prevents the projection portion from moving away from the step portion when the mating portion of the connector housing has been mated to the retainer.

11. The electrical connector according to claim 7, wherein the support member is provided with a restriction portion that opposes a back face of the projection portion of the lock arm when the connector housing is at the first position, and that prevents the projection portion from moving away from the step portion when the mating portion of the connector housing has been mated to the retainer.

12. The electrical connector according to claim 8, wherein the support member is provided with a restriction portion that opposes a back face of the projection portion of the lock arm when the connector housing is at the first position, and that prevents the projection portion from moving away from the step portion when the mating portion of the connector housing has been mated to the retainer.

13. The electrical connector according to claim 1, wherein an end face on the counter mating side of the support member and an end face on the counter mating side of the connector housing are provided so as to be flush with each other when the connector housing is at the first position.

14. The electrical connector according to claim 2, wherein an end face on the counter mating side of the support member and an end face on the counter mating side of the connector housing are provided so as to be flush with each other when the connector housing is at the first position.

15. The electrical connector according to claim 3, wherein an end face on the counter mating side of the support member and an end face on the counter mating side of the connector housing are provided so as to be flush with each other when the connector housing is at the first position.

16. The electrical connector according to claim 5, wherein an end face on the counter mating side of the support member and an end face on the counter mating side of the connector housing are provided so as to be flush with each other when the connector housing is at the first position.

17. The electrical connector according to claim 9, wherein an end face on the counter mating side of the support member and an end face on the counter mating side of the connector housing are provided so as to be flush with each other when the connector housing is at the first position.

18. A squib connection device comprising:

a partner device including:

an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector that can be mated to the partner device, wherein the electrical connector includes a support member, a connector housing that has a mating portion capable of being mated to the retainer, and that is provided such that the position of the connector housing relative to the support member can move between a first position and a second position that is on the mating side relative to the first position, an electrical terminal that is provided in the connector housing and has a contact portion that can come into contact with the squib terminal at least when the mating portion of the connector housing is mated to the retainer, and an elastic member that is provided between the support member and the connector housing and presses the connector housing toward the counter mating side relative to the support member using elastic restoring force, wherein the support member is provided with a flexible leg portion that extends toward the mating side, an end portion on the mating side of the leg portion being provided with an abutting portion capable of abutting against a receiving face formed on the mating side of a jutting portion that is provided on the retainer so as to jut out laterally, wherein the connector housing is provided with a pressing portion that presses the leg portion laterally such that the leg portion moves away from the receiving face when the connector housing moves from the first position to the second position, and wherein when the abutting portion of the leg portion of the support member is abutted against the receiving face of the jutting portion of the retainer, and the connector housing at the first position is pressed toward the mating side, the elastic member undergoes elastic deformation, and if the connector housing does not reach the second position, the connector housing returns to the first position due to being pressed in the counter mating direction relative to the support member by elastic restoring force of the elastic member, and if the connector housing reaches the second position, the abutting portion moves away from the receiving face due to being pressed by the pressing portion, the support member is pressed toward the mating side due to being subjected to elastic restoring force of the elastic member, and the connector housing becomes relatively positioned at the first position.

* * * * *